US009206003B2

(12) United States Patent
Fukazawa et al.

(10) Patent No.: US 9,206,003 B2
(45) Date of Patent: Dec. 8, 2015

(54) MEDIA PROCESSING DEVICE, AND CONTROL METHOD OF MEDIA PROCESSING DEVICE

(71) Applicant: Seiko Epson Corporation, Tokyo (JP)

(72) Inventors: Hiroyasu Fukazawa, Matsumoto (JP); Ryuji Moriyama, Matsumoto (JP); Yuta Ichimiya, Shiojiri (JP); Chikako Akahane, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/457,750

(22) Filed: Aug. 12, 2014

(65) Prior Publication Data

US 2015/0042031 A1 Feb. 12, 2015

(30) Foreign Application Priority Data

Aug. 12, 2013 (JP) ..... 2013-167341

(51) Int. Cl.
*B65H 3/56* (2006.01)
*B65H 3/52* (2006.01)

(52) U.S. Cl.
CPC ..... *B65H 3/565* (2013.01); *B65H 3/5261* (2013.01); *B65H 2403/481* (2013.01); *B65H 2403/72* (2013.01)

(58) Field of Classification Search
CPC ..... B65H 3/34; B65H 3/46; B65H 3/5246; B65H 3/5253; B65H 3/5261; B65H 3/5276; B65H 3/5284; B65H 3/54; B65H 3/56; B65H 3/565
USPC ..... 271/122, 125, 121
See application file for complete search history.

(56) References Cited

U.S. PATENT DOCUMENTS

| | | | | |
|---|---|---|---|---|
| 5,449,162 | A * | 9/1995 | Saito et al. | 271/122 |
| 5,984,298 | A * | 11/1999 | Wada et al. | 271/121 |
| 7,896,342 | B2 * | 3/2011 | Tsukamoto et al. | 271/265.04 |
| 2009/0001647 | A1 | 1/2009 | Izuchi | |
| 2012/0314267 | A1 | 12/2012 | Suzuki et al. | |

FOREIGN PATENT DOCUMENTS

| | | | |
|---|---|---|---|
| JP | H10-291662 | A | 11/1998 |
| JP | 2003-072964 | A | 3/2003 |
| JP | 3624685 | B2 | 3/2005 |
| JP | 2009-007106 | A | 1/2009 |
| JP | 2012-254856 | A | 12/2012 |

* cited by examiner

*Primary Examiner* — Jeremy R Severson
(74) *Attorney, Agent, or Firm* — Nutter McClennen & Fish LLP; John J. Penny, Jr.; Joshua I. Rudawitz

(57) ABSTRACT

A media processing device executes a retard preparation operation that moves a separation roller and a paper return lever at a desired time even when the moving mechanism that moves a separation roller and a paper return lever together, and the conveyance mechanism that conveys the medium, share a common drive source. A printer has a moving mechanism that executes a retard preparation operation that moves the paper return lever and separation roller in conjunction with each other. Drive power from the conveyance motor is transferred to the moving mechanism. The printer also has a trigger lever that can move between an interference position physically interfering with the moving mechanism and preventing the retard preparation operation from starting, and an actuator that moves the trigger lever from the interference position to a non-interference position.

12 Claims, 14 Drawing Sheets

MEDIA PROCESSING DEVICE, AND CONTROL METHOD OF MEDIA PROCESSING DEVICE

Priority is claimed under 35 U.S.C. §119 to Japanese Application No. 2013-167341 filed on Aug. 12, 2013, which is hereby incorporated by reference in its entirety.

BACKGROUND

1. Technical Field

The present invention relates to a media processing device that continuously conveys plural media through a conveyance path from a media supply unit to a paper exit past a processing position where the media is processed, and to a control method of the media processing device.

2. Related Art

JP-A-2003-72964 discloses a printer having a paper cassette that stores plural sheets of printing paper; a conveyance path passing the print position of the printhead to the paper exit; a paper supply mechanism that delivers the printing paper from the paper cassette to the conveyance path; and a conveyance mechanism that conveys the printing paper fed into the conveyance path through the conveyance path. In the printer in JP-A-2003-72964, the printing paper fed into the conveyance path by the paper supply mechanism is conveyed through the conveyance path by the conveyance mechanism and printed on as it passes the print position, and the printed paper is then discharged from the paper exit. The paper supply mechanism feeds a new sheet of paper from the paper cassette before the paper already being conveyed through the conveyance path is discharged from the paper exit. This improves the throughput of continuous printing when printing continuously on plural sheets of paper.

If the paper supply mechanism feeds multiple sheets of paper at the same time from the paper cassette, the conveyance mechanism feeds the overlapping sheets at the same time through the conveyance path. This is a problem known as double-feeding. To prevent double-feeding, the printer disclosed in JP-A-2009-7106 has a paper separating mechanism (also known as a retard mechanism) at the upstream end of the conveyance path in the conveyance direction.

The paper separating mechanism disclosed in JP-A-2009-7106 has a separating roller and a paper return lever. This separating roller is generally called a retard roller, and is pressed against a second conveyance roller of the conveyance mechanism disposed at the upstream end of the conveyance path. The separating roller applies a load to the printing paper passing the nipping part with the second conveyance roller, separating and passing only one sheet of paper from the plural sheets of double-fed paper. After the sheet of paper separated by the separating roller passes the nipping point, part of the paper return lever protrudes into the conveyance path and returns the paper that did not pass through the nipping point to the paper cassette side.

The paper return lever returns the excess sheets to the paper cassette side as a result of being set to a paper return position where part of the lever protrudes into the conveyance path. Before supplying the next sheet of paper starts, the paper return lever is preferably set to a retracted position removed from the conveyance path to that the lever does not interfere with the paper fed from the paper cassette to the conveyance path.

The separating roller, however, must be set to the pressure position pressed against the second conveyance roller before the supply operation starts, and is preferably set to a retracted position separated from the second conveyance roller so that the separating roller does not interfere with the paper return operation of the paper return lever after the single sheet passes the nipping point.

A printer or other media processing device having a paper return lever and a separating roller therefore preferably also has an operating mechanism that moves the paper return lever and the separating roller in conjunction with each other, and performs a retard retard preparation operation that moves the paper return lever from the paper return position to the retracted position, and moves the separating roller from the retracted position to the pressure position, position, before the paper supply operation is performed by the paper supply mechanism.

If the drive power of the moving mechanism that moves the paper return lever and the separating roller comes from the paper feed motor that drives the conveyance mechanism, the manufacturing cost of the device can be suppressed. However, if the moving mechanism and the conveyance mechanism share the same drive source, the retard preparation operation of the moving mechanism and the paper feed operation of the conveyance mechanism work at the same time, and starting starting the retard preparation operation at a separate desired timing timing is difficult. If the retard preparation operation cannot be started at the desired timing, the paper supply operation of the supply supply mechanism cannot be executed at the desired time, and adjusting the interval between two sheets of paper fed consecutively through the conveyance path appropriately to print modes of different print resolutions is difficult.

SUMMARY

A media processing device according to at least one embodiment of the present invention can perform the retard preparation operation that moves the separation roller and the paper return lever at a desired time even when the same drive source is used for the moving mechanism that moves the separation roller and the paper return lever in conjunction with each other, and for the conveyance mechanism that conveys media through the conveyance path. A control method of a media processing device according to at least one embodiment of the invention controls consecutive conveyance of media by the media processing device.

A media processing device according to at least one embodiment of the invention comprises a conveyance path extending from a supply unit that stores plural sheets of media to a discharge exit; a first conveyance roller that conveys the media through the conveyance path; a separation roller that can move between a pressure position at which the separation roller is pressed to the first conveyance roller, and a release position at which the separation roller is separated from the first conveyance roller; a paper return lever that can move between a paper return position where a part of the paper return lever protrudes into the conveyance path upstream from the first conveyance roller, and a retracted position where the paper return lever is retracted from the conveyance path; a moving mechanism that performs a retard preparation operation that moves the paper return lever from the paper return position to the retracted position, and moves the separation roller from the release position to the pressure position; and a trigger lever that can move between an interference position physically interfering with the moving mechanism and preventing the retard preparation operation, and a non-interference position not interfering with the moving mechanism and allowing the retard preparation operation to start.

With this configuration, the retard preparation operation that moves the paper return lever and separation roller is obstructed when the trigger lever is in the interference position, and when the trigger lever moves to the non-interference position, the trigger lever does not interfere with the moving mechanism and the retard preparation operation can proceed. The retard preparation operation can therefore be started at the desired timing by driving the trigger lever at the desired drive timing even when the drive source of the moving mechanism that moves the paper return lever and separation roller together, and the drive source of the first conveyance roller, second conveyance roller (described below), and discharge roller (described below) that convey the medium through the conveyance path, are the same. The supply operation that feeds new media to the conveyance path can therefore be executed at the desired time.

In another aspect of at least one embodiment of the invention, the media processing device preferably also has a conveyance motor; the first conveyance roller, a second conveyance roller, and a discharge roller disposed in order from the upstream side in the conveyance direction from the supply unit to the discharge exit to convey media through the conveyance path; a drive power transfer mechanism that transfers drive power from the conveyance motor to the first conveyance roller, the second conveyance roller, the discharge roller, and moving mechanism; and a supply mechanism that performs a supply operation in which a new medium is delivered to the conveyance path from the supply unit when the retard preparation operation ends before the medium is discharged from the discharge exit.

This configuration enables the use of the conveyance motor that is the drive source of the first conveyance roller, the second conveyance roller, and the discharge roller as the drive source of the moving mechanism. The manufacturing cost of the media processing device can therefore be suppressed. Media can also be conveyed continuously because new media is supplied when the retard preparation operation ends before the previous medium is discharged from the discharge exit.

In another aspect of at least one embodiment of the invention, the media processing device preferably has a control unit that controls driving the conveyance motor and an actuator that moves the trigger lever from the interference position to the non-interference position; and a detector that detects and outputs to the control unit whether or not the medium is at a detection position set on the conveyance path between the first conveyance roller and the second conveyance roller. When a discharge command to discharge the media from the discharge exit is acquired while the conveyance motor is driving and the detector output is in a media-detected state, the control unit drives the actuator when the detector output changes to a no-media state; and when the discharge command has not been acquired while the conveyance motor is driving and the detector output is in a no-media state, the control unit drives the actuator when the discharge command is acquired.

This configuration can determine the timing for driving the trigger lever based on output from the detector and acquisition of the discharge command. As a result, the actuator is driven and new media is delivered to the conveyance path after confirming based on the discharge command that the processing unit has completed processing of the medium conveyed first. Contact on the conveyance path between the medium conveyed first through the conveyance path and the new medium delivered to the conveyance path can therefore be prevented even when the conveyance speed of the medium conveyed to the processing position drops due to the process of the processing unit.

In another aspect of at least one embodiment of the invention, the media processing device preferably has a control unit that controls driving of the conveyance motor and an actuator; and a detector that detects and outputs to the control unit whether or not the medium is at a detection position set on the conveyance path between the first conveyance roller and the second conveyance roller. The control unit calculates a cumulative conveyance distance in the conveyance direction of the medium from the time the detector output changes from the no-media state to the media-detected state, and drives the actuator based on the cumulative conveyance distance and the length of the medium in the conveyance direction.

This configuration enables the control unit to know the position of the trailing end in the conveyance direction of the medium conveyed first through the conveyance path based on the cumulative conveyance distance and the length of the medium. The control unit can therefore drive the actuator at a drive timing resulting in a desired distance at which the trailing end in the conveyance direction of the medium conveyed first through the conveyance path, and the leading end in the conveyance direction of the new medium delivered to the conveyance path, do not touch. The distance on the conveyance path between the medium conveyed first through the conveyance path and the new medium delivered to the conveyance path can therefore be shortened.

In another aspect of at least one embodiment of the invention, the media processing device preferably has a control unit that controls driving of the conveyance motor and an actuator; and a detector that detects and outputs to the control unit whether or not the medium is at a detection position set on the conveyance path between the first conveyance roller and the second conveyance roller. The control unit drives the actuator when the detector output changes from the media-detected state to the no-media state while the conveyance motor is driving.

This configuration can determine the timing for driving the trigger lever based on output from the detector. Because conveying the next new medium starts after the medium conveyed first through the conveyance path has passed the detection position, by setting the detection position to an appropriate position, contact on the conveyance path between the medium already detected by the detector (the medium conveyed first through the conveyance path), and the new medium delivered to the conveyance path, can be prevented.

Another aspect of at least one embodiment of the invention is a control method of the media processing device, the media processing device having a detector that detects and outputs whether or not the medium is at a detection position set on the conveyance path between the first conveyance roller and the second conveyance roller. The control method includes: executing a conveyance operation of driving the conveyance motor, rotating the first conveyance roller, the second conveyance roller, and the discharge roller, and conveying the medium delivered from the supply unit to the conveyance path in the conveyance direction; setting the trigger lever to the interference position; if the detector output is in a media-detected state and a discharge command to discharge the media from the discharge exit has been acquired, driving the actuator and starting the retard preparation operation when the detector output changes to a no-media state; and if the discharge command is not acquired after the detector output changes from the media-detected state to the no-media state, driving a processing unit and an actuator that moves the trigger lever from the interference position to the non-interference position, and starting the retard preparation operation, when the discharge command is acquired.

This configuration can determine the timing for driving the trigger lever based on output from the detector and acquisition of the discharge command. As a result, the actuator is driven and new media is delivered to the conveyance path after confirming based on the discharge command that the processing unit has completed processing the medium conveyed first. Contact on the conveyance path between the medium conveyed first through the conveyance path and the new medium delivered to the conveyance path therefore can be prevented even when the conveyance speed of the medium conveyed to the processing position drops due to the process of the processing unit.

Another aspect of at least one embodiment of the invention is a control method of a media processing device that also comprises a detector that detects and outputs whether or not the medium is at a detection position set on the conveyance path between the first conveyance roller and the second conveyance roller. The control method includes: executing a conveyance operation of driving the conveyance motor, rotating the first conveyance roller, the second conveyance roller, and the discharge roller, and conveying the medium delivered from the supply unit to the conveyance path in the conveyance direction; setting the trigger lever to the interference position; calculating a cumulative conveyance distance of the medium conveyed in the conveyance direction from the time the detector output changes from the no-media state to the media-detected state, and setting a drive timing to drive the actuator based on the cumulative conveyance distance and the length of the medium in the conveyance direction; and driving the actuator and starting the retard preparation operation at the drive timing.

This configuration enables the control unit to know the position of the trailing end in the conveyance direction of the medium conveyed first through the conveyance path based on the cumulative conveyance distance and the length of the medium. The control unit can therefore drive the actuator at a drive timing resulting in a desired distance at which the trailing end in the conveyance direction of the medium conveyed first through the conveyance path, and the leading end in the conveyance direction of the new medium delivered to the conveyance path, do not touch. The distance on the conveyance path between the medium conveyed first through the conveyance path and the new medium delivered to the conveyance path can therefore be shortened.

The control method of the media processing device according to another aspect of at least one embodiment of the invention further includes: setting the time when the trailing end in the conveyance direction of the medium detected by the detector is determined to pass the nipping part of the first conveyance roller and the separation roller as the drive timing based on the cumulative conveyance distance and the length of the medium in the conveyance direction; and driving the actuator at the drive timing.

This configuration enables setting a minimal distance between the medium conveyed first through the conveyance path and the new medium delivered to the conveyance path.

Another aspect of at least one embodiment of the invention is a control method of the media processing device wherein the media processing device has a clutch mechanism that transfers drive power from the conveyance motor to the first conveyance roller when the conveyance motor is driven in a first direction, and interrupts transfer of drive power to the first conveyance roller when the conveyance motor is driven in a second direction that is the reverse of the first direction.

The control method also comprises: driving the conveyance motor in the first direction in the conveyance operation; setting the time when the distance between the medium detected by the detector and a new medium supplied next from the supply unit to the conveyance path is determined to be greater than the distance between the second conveyance roller and the discharge roller as the drive timing based on the cumulative conveyance distance and the length of the medium in the conveyance direction; driving the actuator and starting the retard preparation operation at the drive timing; executing the supply operation and the conveyance operation of a new medium after the retard preparation operation ends; executing a de-skewing operation; and then resuming the conveyance operation.

The de-skewing operation includes: conveying the new medium a first conveyance distance that is greater than the distance between the detection position and the second conveyance roller when the detector output changes from the no-media state to the media-detected state; driving the conveyance motor in the second direction and conveying the medium in a reverse conveyance direction that is the opposite of the conveyance direction a second conveyance distance that is less than the first conveyance distance so that the new medium is not nipped; and setting the new medium against the second conveyance roller.

The distance between the trailing end in the conveyance direction of the medium conveyed first through the conveyance path, and the leading end in the conveyance direction of the new medium delivered from the supply unit, is greater than the distance between the second conveyance roller and the discharge roller in this aspect of the invention. As a result, when the new medium is conveyed in the reverse conveyance direction in the de-skewing operation, the medium conveyed first through the conveyance path has already been discharged to a position separated from the discharge exit side from the discharge roller. The medium conveyed first through the conveyance path being conveyed in the reverse conveyance direction in conjunction with the de-skewing operation applied to the new medium can therefore be avoided.

Another aspect of at least one embodiment of the invention is a control method of the media processing device wherein the media processing device also comprises a detector that detects and outputs whether or not the medium is at a detection position set on the conveyance path between the first conveyance roller and the second conveyance roller. The control method includes: executing a conveyance operation of driving the conveyance motor, rotating the first conveyance roller, the second conveyance roller, and the discharge roller, and conveying the medium delivered from the supply unit to the conveyance path in the conveyance direction; setting the trigger lever to the interference position; and driving the actuator and starting the retard preparation operation when the detector output changes from the media-detected state to the no-media state.

This configuration can determine the timing for driving the trigger lever based on output from the detector. Because conveying the next new medium starts after the medium conveyed first through the conveyance path has passed the detection position, by setting the detection position to an appropriate position, contact on the conveyance path between the medium already detected by the detector (the medium conveyed first through the conveyance path), and the new medium delivered to the conveyance path, can be prevented.

Another aspect of at least one embodiment of the invention is a control method of the media processing device wherein the media processing device has a printhead that executes a printing process, a detector that detects and outputs whether or not the medium is at a detection position set on the conveyance path between the first conveyance roller and the second conveyance roller, and a conveyance motor that drives the supply mechanism and a supply roller. The control method includes: executing a conveyance operation of driving the conveyance motor, rotating the first conveyance roller, the second conveyance roller, and the discharge roller, and conveying the medium delivered from the supply unit to the conveyance path in the conveyance direction; setting the trigger lever to the interference position; calculating a cumulative conveyance distance of the medium conveyed in the conveyance direction from the time the detector output changes from the no-media state to the media-detected state, and setting a drive timing to drive the actuator based on the cumulative conveyance distance and the length of the medium in the conveyance direction; alternating the printing operation on the medium at the processing position and the conveyance operation in the printing process; acquiring the conveyance distance of each conveyance operation performed alternately in the printing process; driving the actuator at the drive timing and starting the retard preparation operation if the conveyance distance is greater than the minimum conveyance amount of the supply mechanism corresponding to the resolution of the conveyance motor; and driving the actuator at a timing later than the drive timing and starting the retard preparation operation if the conveyance distance is less than the minimum conveyance amount of the supply mechanism.

When the media processing device is a printer having a printhead as the processing unit, the conveyance amount of each conveyance operation performed intermittently during the printing process may be a very small amount depending on the print resolution, and this conveyance amount may be less than the minimum conveyance amount that the supply mechanism advances the medium when the supply motor is driven the minimum angle corresponding to the resolution of the motor. If the retard preparation operation executes and the supply operation starts at a predetermined drive timing in this event, the conveyance amount of the new medium delivered to the conveyance path by the paper supply operation may be large, and the new medium may collide with the medium conveyed first through the conveyance path. The new medium colliding with the medium conveyed first through the conveyance path is therefore prevented by executing the retard preparation operation and starting the supply operation at a timing delayed from the predetermined drive timing.

This control method of the media processing device further preferably includes: driving the actuator and starting the retard preparation operation if the output changes to the no-media state when the conveyance distance is less than the minimum conveyance amount of the supply mechanism, the output of the detector is the media-detected state, and a discharge command to discharge the medium from the discharge exit has been acquired; and driving the actuator and starting the retard preparation operation if the discharge command is acquired when the discharge command has not been acquired after the detector output changes from the media-detected state to the no-media state.

This configuration can determine the timing for driving the trigger lever based on output from the detector and acquisition of the discharge command. As a result, the actuator is driven and new media is delivered to the conveyance path after confirming based on the discharge command that the processing unit has completed processing the medium conveyed first. Contact on the conveyance path between the medium conveyed first through the conveyance path and the new medium delivered to the conveyance path can therefore be prevented even when the conveyance speed of the medium conveyed to the processing position drops due to the process of the processing unit.

This control method of the media processing device further preferably includes: calculating a second cumulative conveyance distance of the medium from when the drive timing is reached if the conveyance distance is less than the minimum conveyance amount of the supply mechanism, and driving the actuator and starting the retard preparation operation if the second cumulative conveyance distance is less than the minimum conveyance amount.

This configuration can prevent the medium conveyed first through the conveyance path and the new medium delivered to the conveyance path from contacting on the conveyance path even when the conveyance amount of the new medium delivered to the conveyance path by the paper supply operation is large.

At least one embodiment of the invention enables starting the retard preparation operation at the desired timing by driving the trigger lever at the desired drive timing even when the drive source of the moving mechanism that moves the paper return lever and separation roller together, and the drive source of the first conveyance roller, second conveyance roller (described below), and discharge roller (described below) that convey the medium through the conveyance path, are the same. The supply operation that feeds new media to the conveyance path can therefore be executed at the desired time.

Other objects and attainments together with a fuller understanding of the invention will become apparent and appreciated by referring to the following description and claims taken in conjunction with the accompanying drawings.

DESCRIPTION OF EMBODIMENTS

A preferred embodiment of a printer as an example of a media processing device according to the present invention is described below with reference to the accompanying figures.

Figure 1:
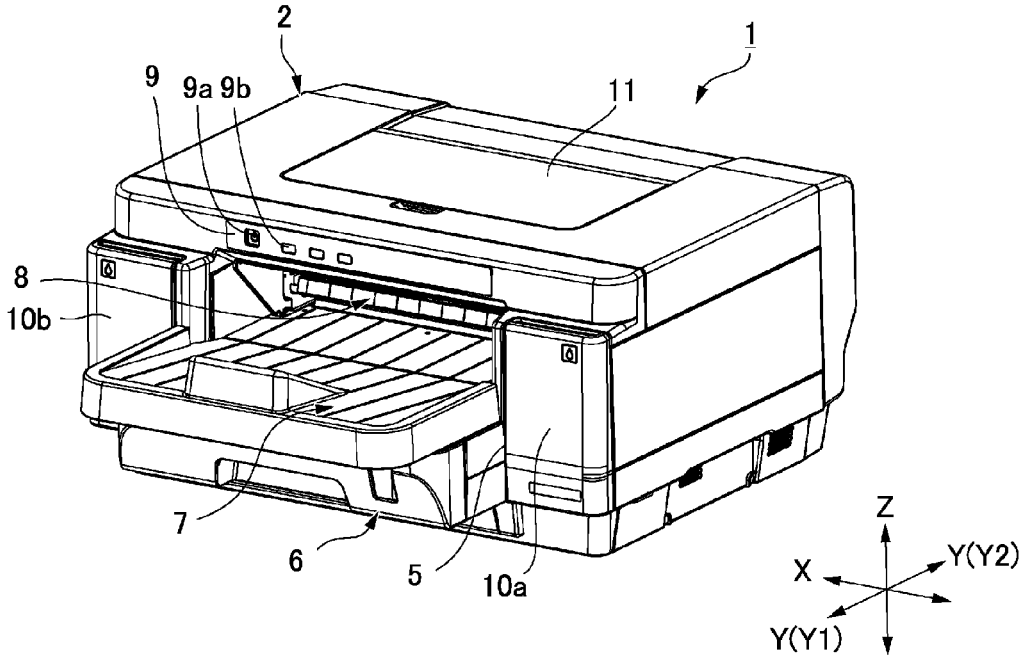
FIG. 1 is an oblique view of a printer according to a preferred embodiment of the invention.

FIG. 1 is an oblique view from above the front of a printer according to this embodiment of the invention. The printer 1 (media processing device) has a basically rectangularly shaped printer cabinet 2 that is long on the transverse (widthwise) axis X.

A paper cassette loading unit 5 is disposed on the front of the printer cabinet 2. The paper cassette loading unit 5 opens to the printer front Y1 (the front on the longitudinal axis Y) at a position toward the bottom on the vertical axis Z in the front of the printer cabinet 2. A paper cassette 6 (supply unit) can be installed from the printer front Y1 into the paper cassette loading unit 5. Printing paper P (media) of a specific size can be loaded in a stack in the paper cassette 6. A paper discharge tray 7 is attached to the top of the paper cassette loading unit 5. The front end of the paper discharge tray 7 protrudes to the printer front Y1 from the printer cabinet 2.

A rectangular paper exit 8 (discharge exit) is formed extending toward the back of the printer above the paper discharge tray 7.

An operating panel 9 is located at the front of the printer above the paper exit 8. The operating panel 9 includes a power switch 9*a* and operating buttons 9*b*. Rectangular access doors 10*a*, 10*b* are attached to the front of the printer cabinet 2 on opposite sides of the paper discharge tray 7 and paper exit 8. When the access doors 10*a*, 10*b* are open, the ink cartridge loading unit (not shown in the figure) opens and the ink cartridges (not shown in the figure) can be replaced.

The top of the printer is flat, and has an access cover 11 attached in the middle for maintenance.

Internal Configuration

Figure 2:
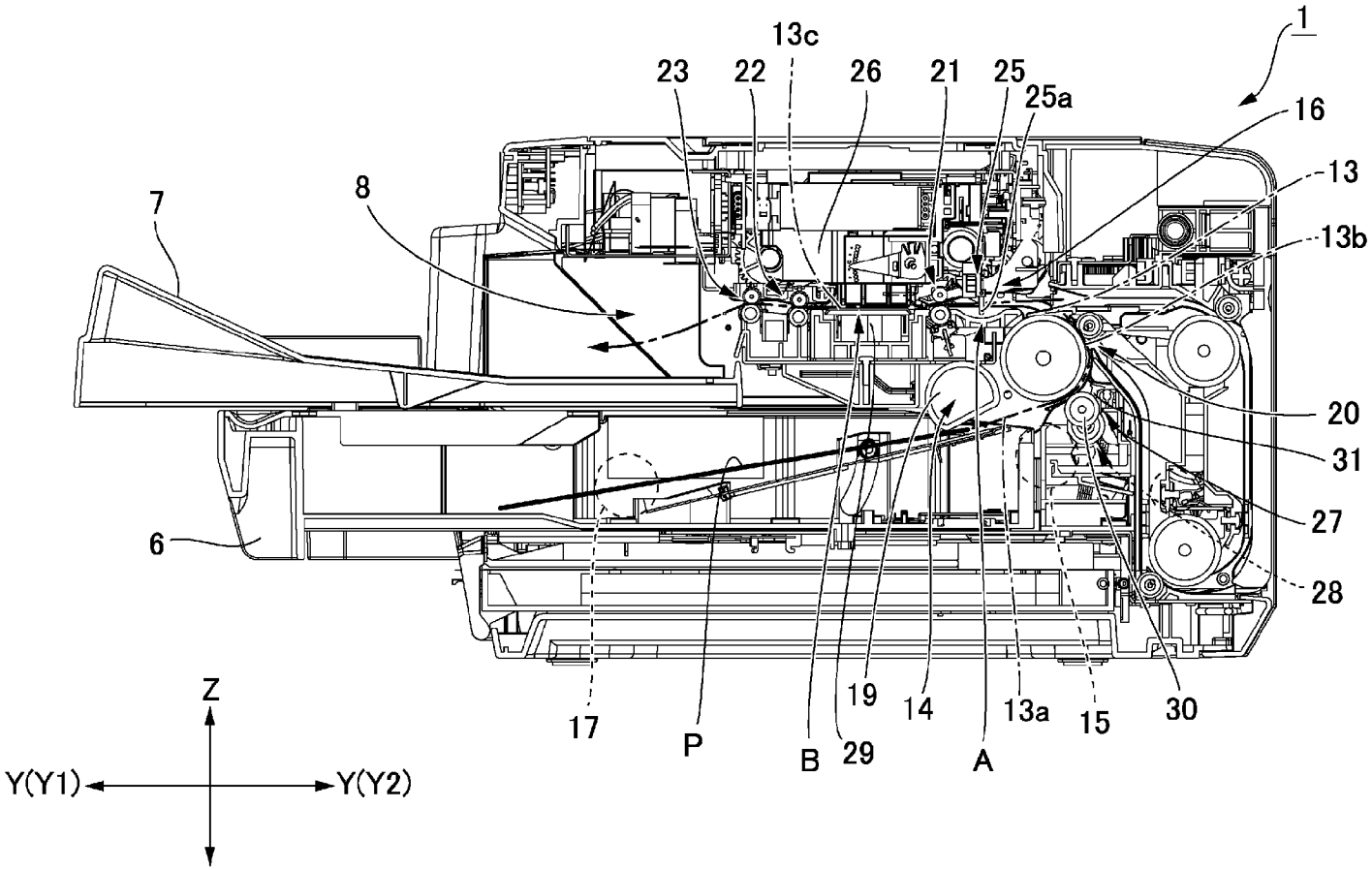
FIG. 2 is a vertical section view of the media processing device shown in FIG. 1.

FIG. 2 is a vertical section view illustrating the internal configuration of the printer 1. A conveyance path 13 for conveying the paper P is formed inside the printer 1. The conveyance path 13 includes a sloped conveyance path portion 13*a* rising diagonally toward the printer back Y2 from the back end of the paper cassette 6; a curved conveyance path portion 13*b* that curves continuously from the back end of the sloped conveyance path portion 13*a* up and around toward the printer front Y1; and a horizontal conveyance path portion 13*c* extending substantially horizontally from the top front end of the curved conveyance path portion 13*b* toward the printer front Y1.

Figure 4A:
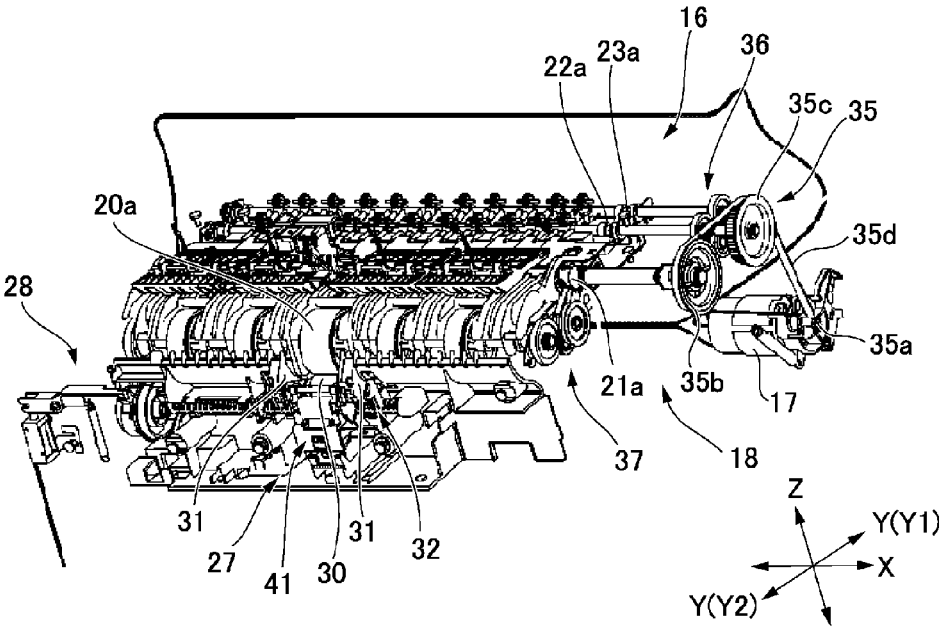
FIGS. 4A and 4B illustrate the conveyance mechanism.
Figure 4B:
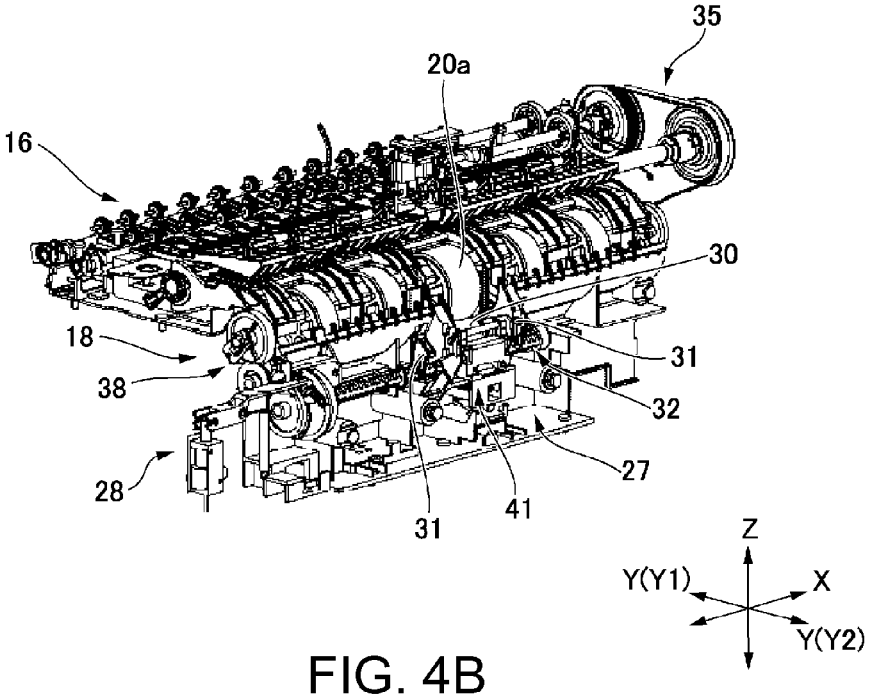

Inside the printer 1 are a paper supply mechanism 14 (supply mechanism), paper feed motor 15, conveyance mechanism 16, conveyance motor 17, and drive power transfer mechanism 18 (FIGS. 4A and 4B).

The paper supply mechanism 14 performs a paper supply operation (supply operation) that delivers paper P from the paper cassette 6 into the conveyance path 13. The paper supply mechanism 14 includes a paper supply roller 19 (supply roller) disposed above the back end of the paper cassette 6. The drive source of the paper supply mechanism 14 is the paper feed motor 15. The paper feed motor 15 is a DC motor, and is disposed below the curved conveyance path portion 13*b*.

The conveyance mechanism 16 performs a conveyance operation that conveys the printer supplied to the conveyance path 13 through the conveyance path 13. The conveyance mechanism 16 includes a first paper feed roller pair 20 (first conveyance roller), second paper feed roller pair 21 (second conveyance roller), first discharge roller pair 22, and second discharge roller pair 23 along the conveyance path 13. The first paper feed roller pair 20, second paper feed roller pair 21, first discharge roller pair 22, and second discharge roller pair 23 are disposed sequentially from the upstream side to the downstream side in the first conveyance direction M1 from the paper cassette 6 to the paper exit 8.

The first paper feed roller pair 20 is disposed in the curved conveyance path portion 13*b*, and the second paper feed roller pair 21, first discharge roller pair 22, and second discharge roller pair 23 are disposed in the horizontal conveyance path portion 13*c*. The drive source of the conveyance mechanism 16 is the conveyance motor 17. The conveyance motor 17 is a DC motor and is disposed beside the paper cassette 6 on the transverse axis X.

Inside the printer 1 are a paper detector 25 (detector), printhead 26, paper separating mechanism 27, and retard preparation operation control mechanism 28 (FIGS. 4A and 4B).

The paper detector 25 detects if the paper P is at a paper detection position A on the conveyance path 13 between the first paper feed roller pair 20 and the second paper feed roller pair 21. This detection position A is at the back part of the horizontal conveyance path portion 13*c*, and the paper detector 25 is disposed above the horizontal conveyance path portion 13*c*. The paper detector 25 has a detection lever 25*a* that is operated by the paper P conveyed through the conveyance path 13, and the paper P is detected based on movement of the detection lever 25*a*.

The printhead 26 is an inkjet head, and prints on the paper P conveyed in the first conveyance direction M1 past the print position B on the conveyance path 13 between the second paper feed roller pair 21 and first discharge roller pair 22. The print position B is on the horizontal conveyance path portion 13*c*. A platen 29 is disposed at a position opposite the nozzle face of the printhead 26 with a specific gap therebetween. The platen 29 defines the print position B.

When plural sheets of paper P are fed at one time by the paper supply mechanism 14, the paper separating mechanism 27 separates and feeds one sheet of paper P to the conveyance mechanism 16. The paper separating mechanism 27 is disposed at the upstreamend of the conveyance path 13 in the first conveyance direction M1 where the sloped conveyance path portion 13*a* and curved conveyance path portion 13*b* connect. The paper separating mechanism 27 includes a separation roller 30 and paper return lever 31, and a moving mechanism 32 (FIGS. 4A and 4B) that moves the separation roller 30 and paper return lever 31 in conjunction with each other. Drive power from the conveyance motor 17 is transferred through the drive power transfer mechanism 18 to the moving mechanism 32. The retard preparation operation control mechanism 28 starts the retard preparation operation of the moving mechanism 32 at a specific drive timing. The retard preparation operation is further described below.

Paper Supply Mechanism

Figure 3A:
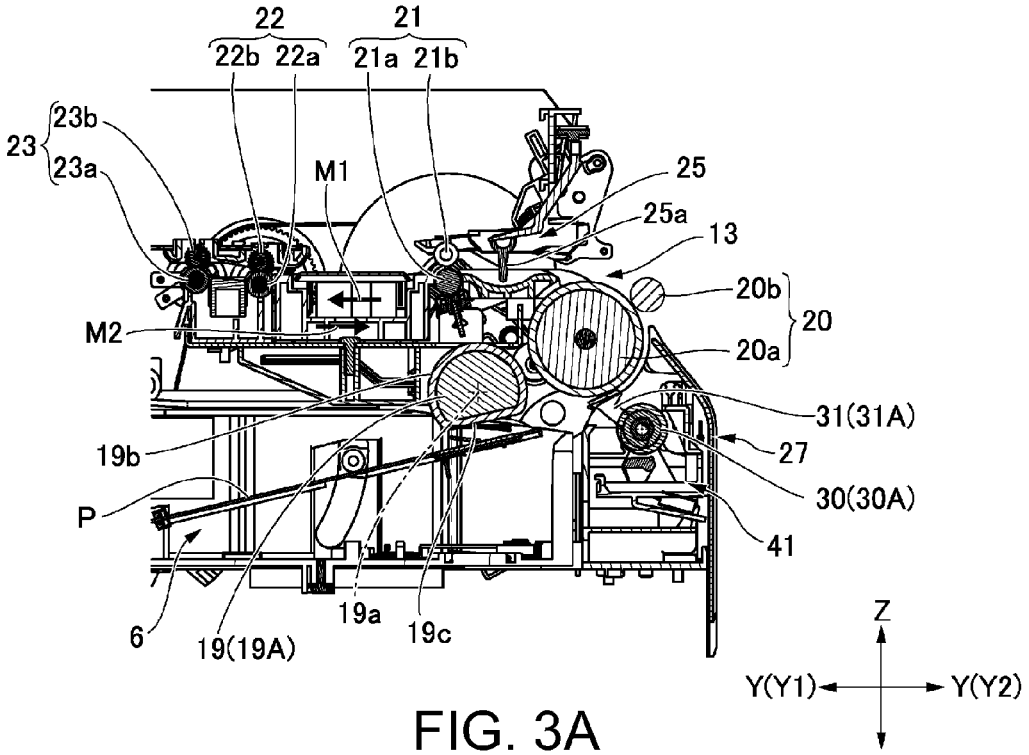
FIGS. 3A and 3B are enlarged section views of the area around the conveyance path.
Figure 3B:
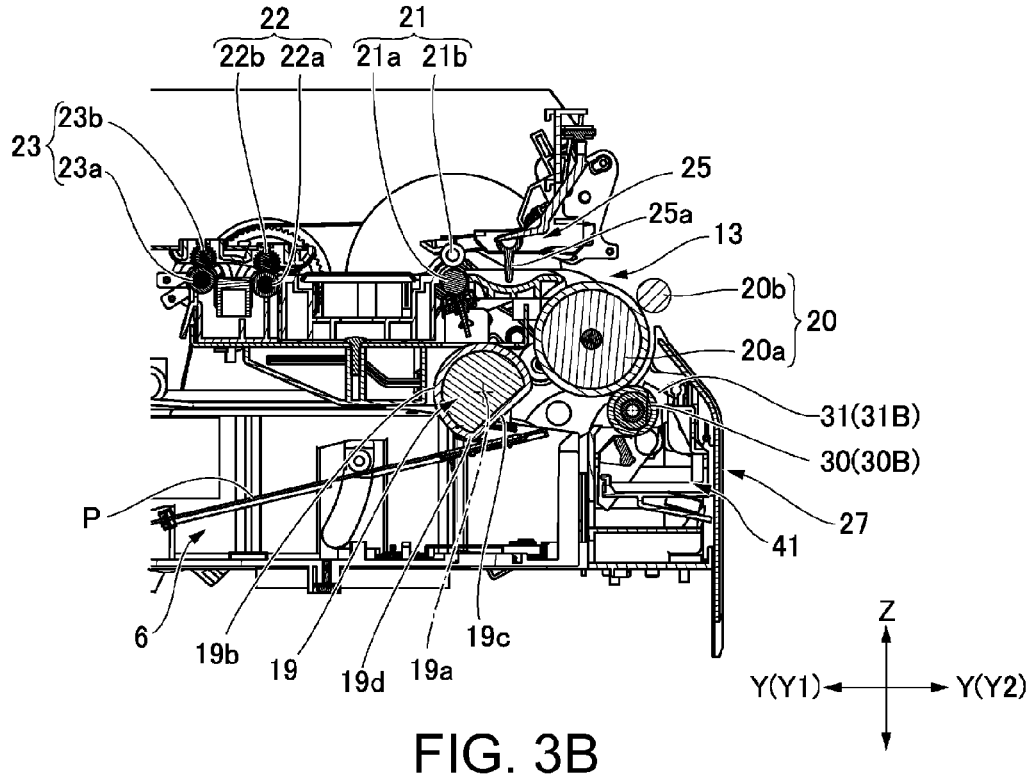

FIGS. 3A and 3B are enlarged section vies of the area around the conveyance path 13 in FIG. 2. FIG. 3A shows the printer 1 in the standby mode, and FIG. 3B shows the printer 1 after the paper supply preparation operation and retard preparation operation are completed in the printer 1. As shown in FIG. 3B, the paper supply roller 19 is disposed with its axis of rotation 19*a* on the transverse axis X. When seen from the end, the paper supply roller 19 is substantially C-shaped with a flat portion formed on the outside surface parallel to the axis of rotation 19*a*, and has a first outside surface 19*b* that is curved when seen from the end on the transverse axis X, and a second outside surface 19*c* that is flat and connects the circumferential ends of the first outside surface 19*b*. The paper supply roller 19 feeds the paper P stored in the paper cassette 6 to the conveyance path 13 when driven one revolution by the paper feed motor 15.

As shown in FIG. 3A, when the printer 1 is in the standby mode, the paper supply roller 19 is in the initial position 19A with the flat second outside surface 19*c* facing down opposite the paper P in the paper cassette 6. To feed a new sheet of paper P to the conveyance path 13, the paper feed motor 15 is driven first in a paper supply preparation operation that sets the ridge 19*d* between the second outside surface 19*c* and first outside surface 19*b* of the paper supply roller 19 in contact with the paper P inside the paper cassette 6. FIG. 3B shows the state when the paper supply preparation operation has ended. When the paper feed motor 15 is driven again after the paper supply preparation operation ends, the first outside surface 19*b* of the paper supply roller 19 contacts the paper P, and the paper P is thereby supplied to the conveyance path 13. Because the paper supply roller 19 turns one revolution in the supply operation, the paper supply roller 19 returns to the initial position 19A shown in FIG. 3A when the supply operation ends.

As shown in FIGS. 3A and 3B, the first paper feed roller pair 20 includes a first paper feed roller 20*a* and a follower roller 20*b*.

The second paper feed roller pair 21 includes a second paper feed roller 21*a* and a follower roller 21*b*.

The first discharge roller pair 22 includes a first discharge roller 22*a* and a follower roller 22*b*.

The second discharge roller pair 23 includes a second discharge roller 23*a* and a follower roller 23*b*.

Drive power from the conveyance motor 17 is transferred through a drive power transfer mechanism 18 to the first paper feed roller 20*a*, second paper feed roller 21*a*, first discharge roller 22*a*, and second discharge roller 23*a*. The second paper feed roller 21*a* has a friction layer of inorganic particles dispersed in the surface.

The conveyance motor 17 that drives the conveyance mechanism 16 can be driven forward and reverse. The conveyance mechanism 16 conveys the paper P in the first conveyance direction M1 when the conveyance motor 17 drives forward. The conveyance mechanism 16 conveys the paper P in a second conveyance direction M2 (reverse) that is the opposite of the first conveyance direction M1 when the conveyance motor 17 drives in reverse.

Figure 5A:
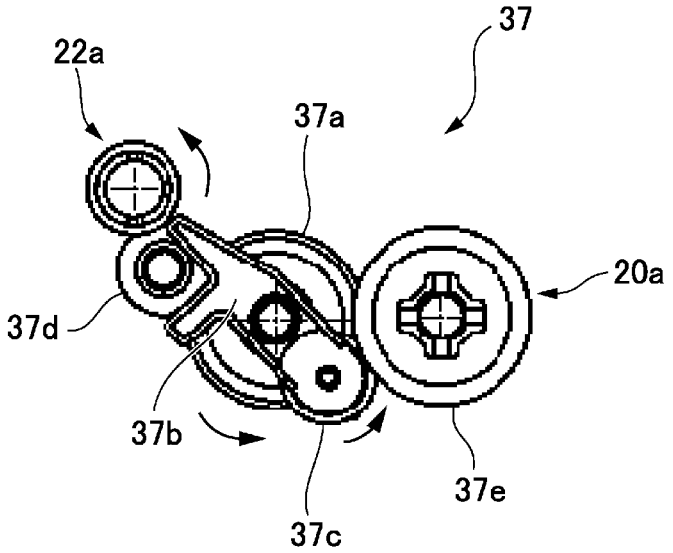
FIGS. 5A and 5B illustrate the clutch mechanism of the conveyance mechanism.
Figure 5B:
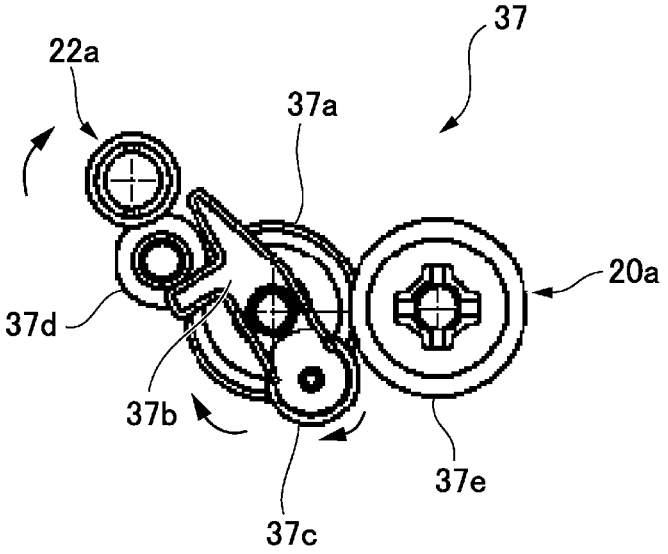

FIGS. 4A and 4B illustrate the conveyance mechanism 16. FIG. 4A is an oblique view from the back of the conveyance mechanism 16 from one side on the transverse axis X, and FIG. 4B is an oblique view of the conveyance mechanism 16 from the back on the other side of the transverse axis X. FIGS. 5A and 5B illustrate the clutch mechanism of the conveyance mechanism 16. FIG. 5A shows when the conveyance motor 17 is driving forward, and FIG. 5B shows when the conveyance motor 17 is driving in reverse.

The drive power transfer mechanism 18 includes a belt and pulley mechanism 35, a first gear mechanism 36, a clutch mechanism 37, and a second gear mechanism 38.

As shown in FIG. 4A, the belt and pulley mechanism 35 transfers drive power from the conveyance motor 17 to the second paper feed roller 21*a* and the first discharge roller 22*a*. The belt and pulley mechanism 35 includes a first timing pulley 35*a* mounted on the output shaft of the conveyance motor 17; a second timing pulley 35*b* fastened coaxially to the drive of the second paper feed roller 21*a*; a third timing pulley 35*c* fastened coaxially to the drive shaft of the first discharge roller 22*a*; and a timing belt 35*d* mounted on the first to third timing pulleys 35*a* to 35*c*.

The first gear mechanism 36 is a gear train composed of plural gears, transfers drive power transferred to the first discharge roller 22*a* to the second discharge roller 23*a*, and turns the first discharge roller 22*a* and second discharge roller 23*a* at the same speed in the same direction.

The clutch mechanism 37 transfers drive power from the conveyance motor 17 to the first paper feed roller 20*a* when the conveyance motor 17 is driven forward, and transfers drive power from the conveyance motor 17 to the first paper feed roller 20*a* when the conveyance motor 17 is driven in reverse. As shown in FIGS. 5A and 5B, the clutch mechanism 37 comprises a sun gear 37*a* to which the drive power from the conveyance motor 17 transferred to the drive shaft of the second paper feed roller 21*a* is transferred; a planetary carrier 37*b* supported pivotably relative to the sun gear 37*a* coaxially to the sun gear 37*a*; and a planetary gear 37*c* that is supported pivotably by the planetary carrier 37*b* and meshes with the sun gear 37*a*. Drive power is transferred from the second paper feed roller 21*a* through an intermediate gear 37*d* to the sun gear 37*a*.

When the conveyance motor 17 drives forward, rotation of the sun gear 37*a* causes the planetary gear 37*c* to move counterclockwise around the sun gear 37*a* as indicated by the arrow in FIG. 5A. Because the planetary carrier 37*b* thus turns counterclockwise, the planetary gear 37*c* meshes with the drive gear 37*e* affixed coaxially to the drive shaft of the 29*a*. Because the planetary carrier 37*b* thus turns counterclockwise, the planetary gear 37*c* meshes with the drive gear 37*e* fastened coaxially to the drive shaft of the first paper feed roller 20*a*. The drive power of the conveyance motor 17 is therefore transferred to the first paper feed roller 20*a*.

When the conveyance motor 17 turns in reverse, rotation of the clutch mechanism 37 causes the planetary gear 37*c* to move clockwise around the sun gear 37*a* as indicated by the arrow in FIG. 5B. As a result, the planetary carrier 37*b* turns clockwise, and the planetary gear 37*c* and the drive gear 37*e* of the first paper feed roller 20*a* disengage. Transfer of drive power from the conveyance motor 17 to the first paper feed roller 20*a* is therefore interrupted.

As shown in FIG. 4B, the second gear mechanism 38 is disposed on the opposite side of the conveyance path 13 on the transverse axis X as the belt and pulley mechanism 35, first gear mechanism 36, and clutch mechanism 37. The second gear mechanism 38 is a gear train composed of plural gears, and transfers drive power transferred to the drive shaft of the first paper feed roller 20*a* to the moving mechanism 32. The second gear mechanism 38 therefore transfers only forward drive power from the conveyance motor 17 to the moving mechanism 32.

Figure 6A:
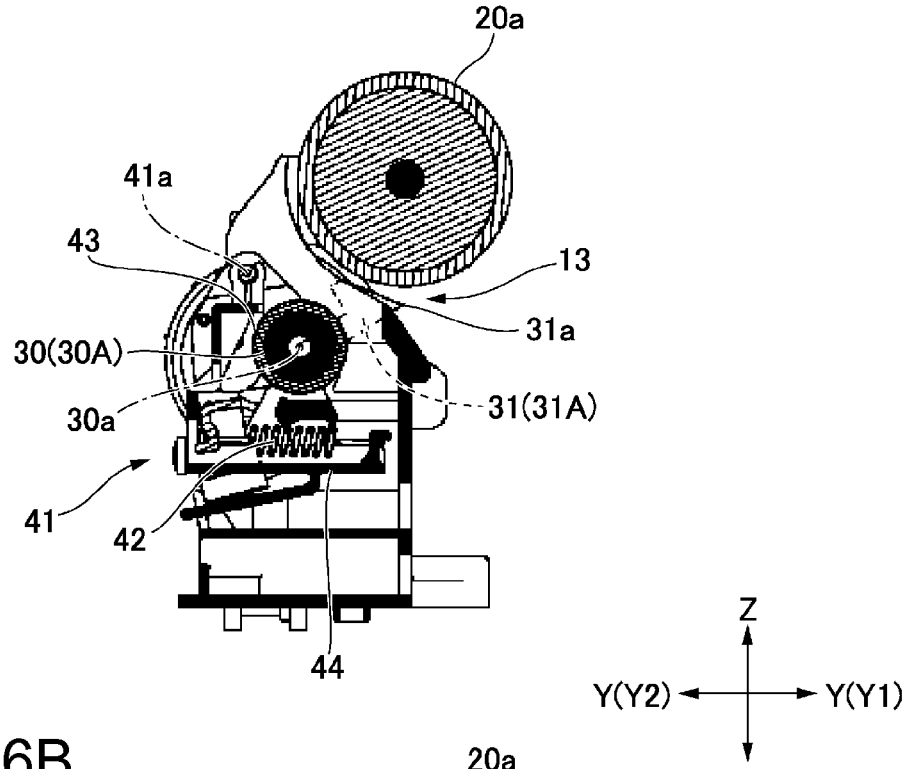
FIGS. 6A and 6B are enlarged section views of the area around the paper separating mechanism.
Figure 6B:
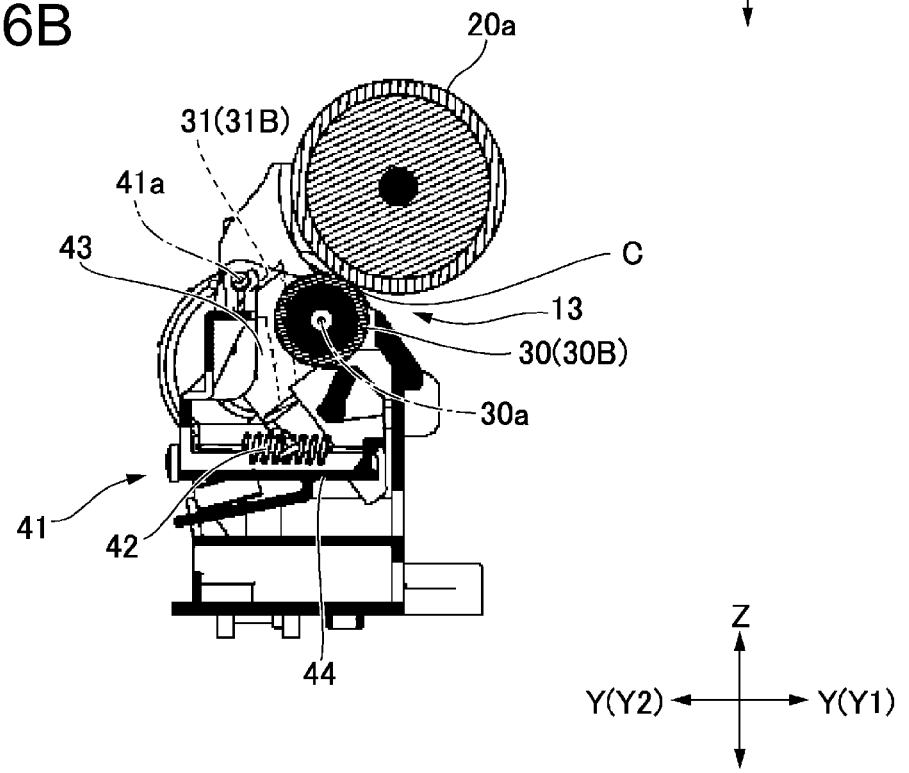
Figure 7:
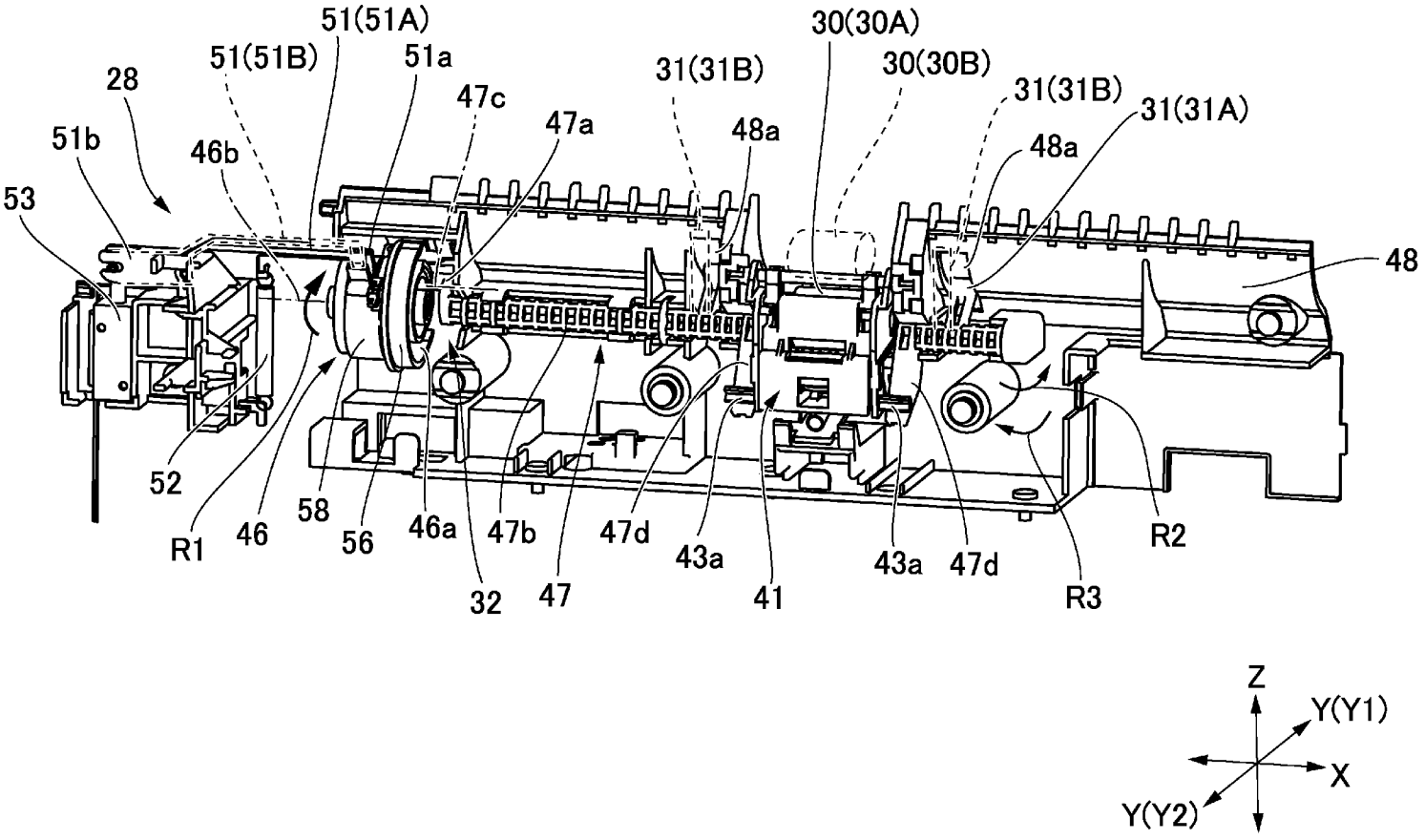
FIG. 7 is an oblique view of the paper separating mechanism and the retard preparation operation control mechanism.

FIGS. 6A and 6B are enlarged section views of the area around the paper separating mechanism 27. FIG. 6A shows when the printer 1 is in the standby mode, and FIG. 6B shows the state of the printer after the paper supply preparation operation and the retard preparation operation. FIG. 7 is an oblique view of the paper separating mechanism 27 and the retard preparation operation control mechanism 28 from the printer back Y2. FIG. 7 shows the printer 1 in the standby mode.

The separation roller 30 is commonly called a retard roller. As shown in FIGS. 4A and 4B, the separation roller 30 is disposed in the middle of the transverse axis X as a unit referred to as a retard roller unit 41. As shown in FIGS. 6A and 6B, the retard roller unit 41 includes the separation roller 30, an urging member 42, a sub-holder 43 that supports the separation roller 30, and a main holder 44 that supports the urging member 42 and sub-holder 43 and enables the sub-holder 43 to rock. The pivot axis 41*a* of the sub-holder 43 is located above and to the printer back Y2 from the axis of rotation 30*a* of the separation roller 30.

The separation roller 30 moves to a release position 30A separated from the first paper feed roller 20*a* as shown in FIG. 6A, and to a pressure position 30B pressed against the first paper feed roller 20*a* as shown in FIG. 6B. The urging member 42 urges the sub-holder 43 in the direction moving the separation roller 30 from the release position 30A to the pressure position 30B. The urging member 42 applies pressure in the direction of the first paper feed roller 20*a* to the separation roller 30. When the separation roller 30 is in the pressure position 30B, a load is applied to the printing paper P conveyed to the nipping position C of the first paper feed roller 20*a* and separation roller 30, and separates one sheet of printing paper P from the plural sheets of paper P fed together (multifed) from the paper cassette 6, and passes only the single sheet of paper P through the nipping position C.

As shown in FIG. 7, the paper return lever 31 is disposed at a position on both sides of the retard roller unit 41 on the transverse axis X. The paper return lever 31 can move between a paper return position 31A shown in FIG. 6A, and a retracted position 31B removed from the conveyance path 13 as shown in FIG. 6B. In the paper return position 31A, the distal end 31*a* of the paper return lever 31 protrudes to the upstream side of the conveyance path 13 from the nipping position C of the first paper feed roller 20*a* and the separation roller 30. When the paper return lever 31 is in the paper return position 31A, the distal end 31*a* protrudes into the conveyance path 13 from an opening 48 in a frame 48 that defines the curved conveyance path portion 13*b* of the conveyance path 13. When the paper return lever 31 moves from the retracted position 31B to the paper return position 31A, the distal end 31*a* of the paper return lever 31 moves from the downstream side to the upstream side of the first conveyance direction M1 while protruding into the conveyance path 13. The excess sheets of printing paper P prevented from passing the nipping position C by the separation roller 30 are therefore returned by the paper return lever 31 to the paper cassette 6 side.

The moving mechanism 32 moves the separation roller 30 between the release position 30A and the pressure position 30B, and moves the paper return lever 31 between the paper return position 31A and the retracted position 31B, in relationship with each other. As shown in FIG. 7, the moving mechanism 32 has a cam member 46 to which drive power from the conveyance motor 17 is transferred through the drive power transfer mechanism 18, and an operating member 47 including a cam follower 47*a* that slides over the cam surface 46*a* of the cam member 46, and a rocker shaft part 47*b* that extends on the transverse axis X below the first paper feed roller 20*a*. The operating member 47 is supported rockably by the frame 48. The axis of rotation 46*b* of the cam member 46, and the axis of rotation 47*c* of the operating member 47 are parallel but not coincident.

The cam member 46 and the rocker shaft part 47*b* of the operating member 47 are disposed on the transverse axis X. Two operating arms 47*d* extending in the radial direction of the rocker shaft part 47*b* are disposed on the rocker shaft part 47*b* at positions on opposite sides of the retard roller unit 41 on the transverse axis X. The sub-holder 43 of the retard roller unit 41 has protrusions 43*a* on the transverse axis X, and the operating arms 47*d* contact the protrusions 43*a* from the printer front Y1. The base of the paper return lever 31 is affixed to the outside sides of the two operating arms 47*d* of the rocker shaft part 47*b*. The paper return lever 31 is affixed perpendicularly to the rocker shaft part 47*b*.

When the printer 1 is in the standby mode, the separation roller 30 is at the release position 30A and the paper return lever 31 is at the paper return position 31A as shown in FIG. 6A and FIG. 7. When the cam member 46 turns one revolution from this position in the direction indicated by arrow R1 in FIG. 7, the cam follower 47*a* slides on the cam surface 46*a* and the operating member 47 rocks bidirectionally through a specific angular range.

More specifically, when the cam member 46 starts turning in direction R1, the rocker shaft part 47*b* rocks in the direction of the printer front Y1 as indicated by arrow R2 in FIG. 7. In conjunction with this rocking action, the operating arms 47*d* move toward the printer front Y1, and move the sub-holder 43 of the retard roller unit 41 toward the printer front Y1. As a result, the separation roller 30 moves from the release position 30A to the pressure position 30B indicated by the dotted line in FIG. 7. When the separation roller 30 is in the pressure position 30B, the separation roller 30 is pressed to the first paper feed roller 20*a* by the urging member 42. As the rocker shaft part 47*b* rocks in the direction of arrow R2, the paper return lever 31 moves from the paper return position 31A to the retracted position 31B.

When the cam member 46 thereafter rotates through a specific angular range, the operating member 47 stops rocking. Therefore, while the cam member 46 rotates through a specific angular range, the separation roller 30 remains at the pressure position 30B and the paper return lever 31 remains at the retracted position 31B.

When the cam member 46 then rotates further in the direction of direction R1, the operating member 47 starts rocking toward the printer back Y2 as indicated by arrow R3 in FIG. 7. Because the operating arms 47*d* return to the original position as the operating member 47 rocks, the sub-holder 43 returns to the original position, and the separation roller 30 moves from the pressure position 30B to the release position 30A. This rocking causes the paper return lever 31 to moves from the paper return position 31A to the original retracted position 31B.

The operation that moves the separation roller 30 from the release position 30A to the pressure position 30B, and moves the paper return lever 31 from the paper return position 31A to the retracted position 31B, is the retard preparation operation for separating printing paper P that is multifed from the paper cassette 6 to the conveyance path 13.

Retard Preparation Operation Control Mechanism

As shown in FIG. 7, the retard preparation operation control mechanism 28 has a trigger lever 51, urging member 52, and actuator 53. The actuator 53 is a solenoid.

The trigger lever 51 is a rod-like member extending on the transverse axis X. One end of the trigger lever 51 is an interference part 51*a* that can interfere with the cam member 46 of the moving mechanism 32, and the other end is an attraction part 51*b* that is attracted by the actuator 53. The trigger lever 51 is supported rockably on an axis extending on the longitudinal axis Y between the interference part 51*a* and attraction part 51*b*. The trigger lever 51 moves between an interference position 51A and a non-interference position 51B. At the interference position 51A, the interference part 51*a* physically interferes with the cam member 46 to which drive power from the conveyance motor 17 is transferred, and prevents the retard preparation operation from starting. At the non-interference position 51B, the interference part 51*a* does not interfere with the moving mechanism 32, and allows the retard preparation operation to start. The urging member 52 is a coil spring, and urges the trigger lever 51 in the direction from the non-interference position 51B to the interference position 51A.

The actuator 53 attracts the attraction part 51*b* when energized, and moves the trigger lever 51 from the interference position 51A to the non-interference position 51B. The actuator 53 is energized for only a preset specific energizing time. In other words, when the actuator 53 is driven, the trigger lever 51 moves from the non-interference position 51B to the interference position 51A, is held at the non-interference position 51B for the energizing time only, and returns from the non-interference position 51B to the interference position 51A when the energizing time ends. The actuator 53 is driven to make the moving mechanism 32 start the retard preparation operation, and the actuator 53 is driven while the conveyance motor 17 is being driven to convey the printing paper P through the conveyance path 13.

Figure 8A:
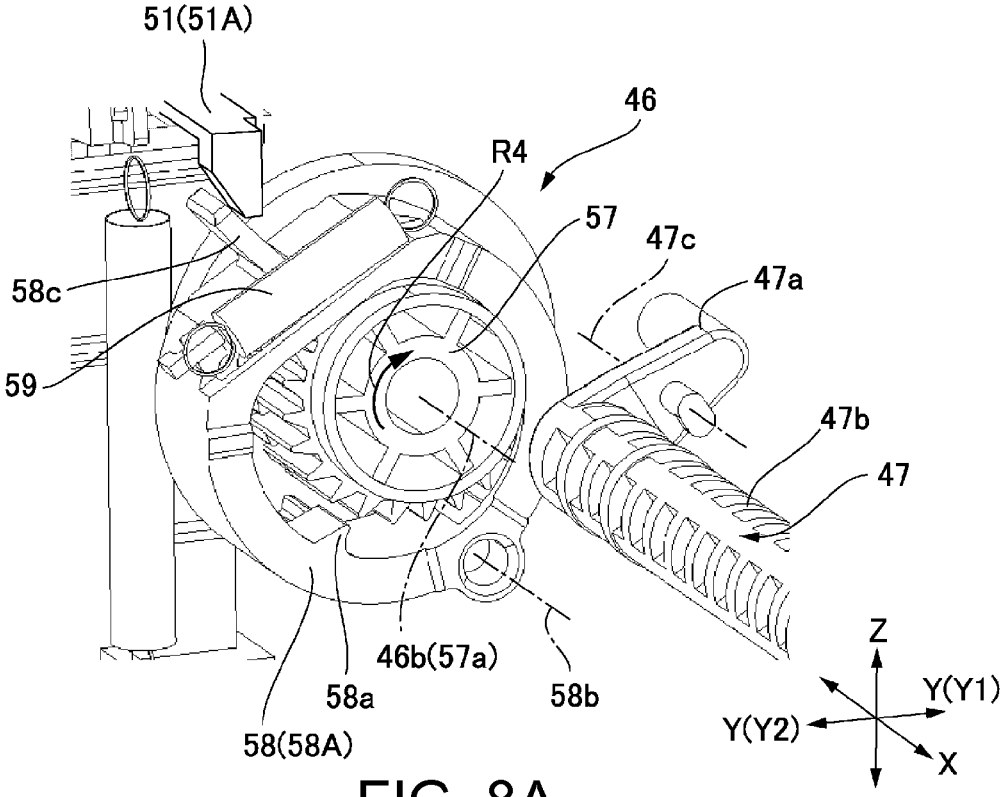
FIGS. 8A and 8B oblique views of another example of a paper detector.
Figure 8B:
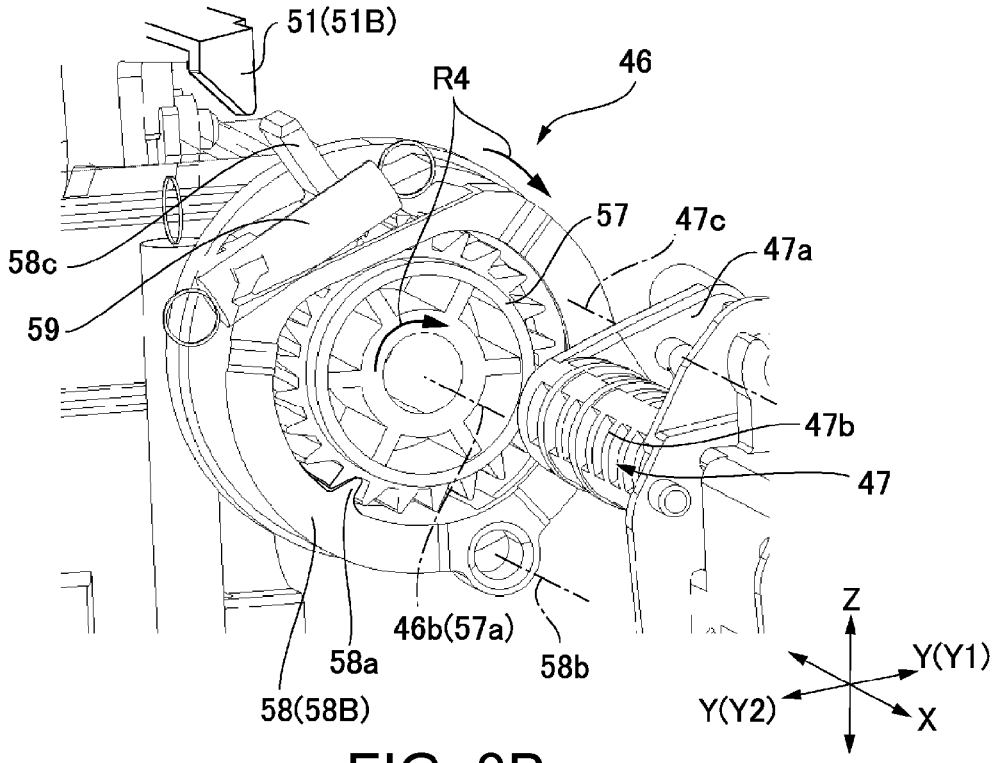

A clutch mechanism 55 is disposed inside the cam member 46 of the moving mechanism 32 that the trigger lever 51 interferes with. When the trigger lever 51 interferes with the cam member 46, the clutch mechanism 55 interrupts transfer of drive power from the conveyance motor 17, and when interference by the trigger lever 51 is removed, the clutch mechanism 55 continues transferring the drive power of the conveyance motor 17. FIGS. 8A and 8B describe the clutch mechanism 55 disposed on the cam member 46. FIG. 8A shows when the trigger lever 51 is in the interference position 51A, and FIG. 8B shows when the trigger lever 51 is in the non-interference position 51B. Note that the cam surface forming member 56 (FIG. 7) on which the cam surface 46*a* of the cam member 46 is formed is not shown in FIGS. 8A and 8B.

As shown in FIGS. 8A and 8B, the cam member 46 has an external gear 57 to which drive power from the conveyance motor 17 is transferred through the drive power transfer mechanism 18, and an annular rotary member 58 with an internal tooth 58*a* on the surface that meshes with the external gear 57. The external gear 57 turns clockwise as indicated by arrow R4 in FIG. 8A while the conveyance motor 17 is driven forward. Note that the cam surface forming member 56 (FIG. 7) is attached to the end of the rotary member 58 on the operating member 47 side.

The rotary member 58 can rock on a pivot axis 58*b* that is below the axis of rotation 57*a* of the external gear 57 and parallel to the axis of rotation 57*a*, and can move between a drive power interrupt position 58A where the internal tooth 58*a* does not engage the external gear 57 as shown in FIG. 8A, and a drive power transfer position 58B where the internal tooth 58*a* engages the external gear 57 as shown in FIG. 8B. When the rotary member 58 is in the drive power transfer position 58B, the rotary member 58 rotates in unison with the external gear 57 around the axis of rotation 57*a* of the external gear 57, that is, around the axis of rotation 46*b* of the cam member 46. The rotary member 58 has a protruding part 58*c* that protrudes from the outside surface. The rotary member 58 is also urged in the direction from the drive power interrupt position 58A to the drive power transfer position 58B by a coil spring or other urging member 59.

If the trigger lever 51 is in the interference position 51A when the conveyance motor 17 is driven, the rotary member 58 is positioned to the drive power interrupt position 58A as a result of contact between the trigger lever 51 and the protruding part 58*c* of the rotary member 58 as shown in FIG. 8A. The drive power from the conveyance motor 17 is therefore transferred to the external gear 57 of the cam member 46, but this drive power is not transferred to the rotary member 58, and the cam surface forming member 56 does not turn. The operating member 47 of the moving mechanism 32 therefore does not rock, and the retard preparation operation is not performed.

If when the conveyance motor 17 is driven, the actuator 53 is energized and the trigger lever 51 moves from the interference position 51A to the non-interference position 51B, the rotary member 58 moves from the drive power interrupt position 58A to the drive power transfer position 58B due to the urging force of the urging member 59. As a result, the rotary member 58 to which the cam surface forming member 56 is disposed starts to turn in unison with the external gear 57. The operating member 47 of the moving mechanism 32 therefore starts rocking, and the retard preparation operation is performed.

The trigger lever 51 then moves from the non-interference position 51B to the interference position 51A after the energizing time passes, but the protruding part 58*c* of the rotary member 58 passes the inside surface side of the trigger lever 51 at this time as shown in FIG. 8B. The rotary member 58 therefore continues turning. When the rotary member 58 turns one revolution, the trigger lever 51 and the rotary member 58 contact again. As a result, the rotary member 58 rocks on the pivot axis 58*b* in resistance to the urging force of the urging member 59, and moves from the drive power transfer position 58B to the drive power interrupt position 58A as shown in FIG. 8 A. Rotation of the rotary member 58 is thereafter prevented, and the retard preparation operation does not transverse axis X again until the actuator 53 is next driven.

Figure 9:
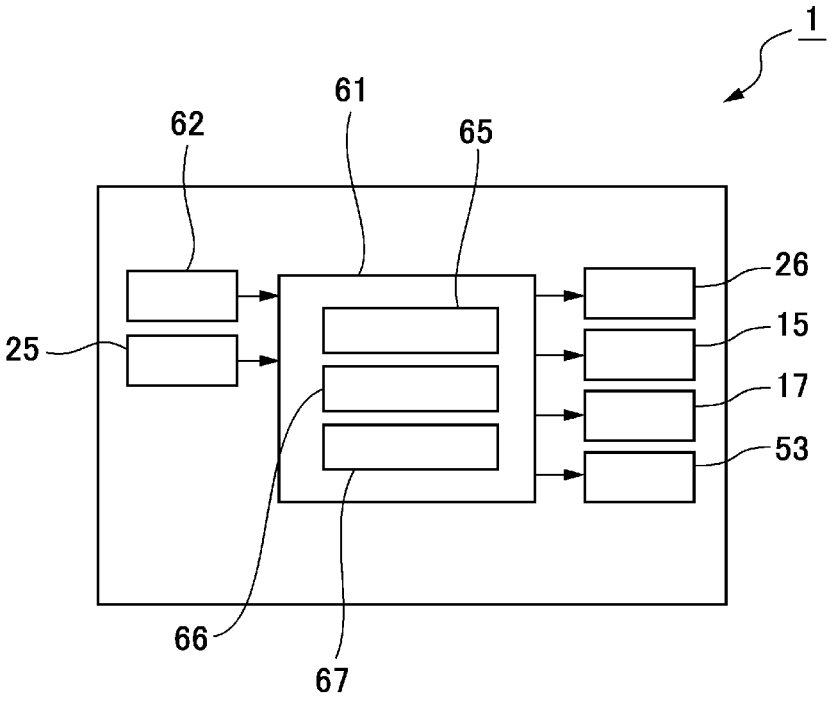
FIG. 9 is a basic block diagram of the printer.

As shown in FIG. 9, the control system of the printer 1 is configured around a control unit 61 including a CPU. A communication unit 62 that can connect to and communicate with a printer 1 and an external device such as a computer, and the paper detector 25, are connected to the input side of the control unit 61. The printhead 26, paper feed motor 15, conveyance motor 17, and actuator 53 are connected to the output side of the control unit 61. The communication unit 62 inputs print data supplied from an external device to the control unit 61 as it is received, and the control unit 61 successively interprets the print data and prints. The control unit 61 also can be implemented using hardware such as a circuit board.

The control unit 61 comprises a position acquisition unit 65 that determines the position of the printing paper P on the conveyance path 13 based on output from the paper detector 25. More specifically, the position acquisition unit 65 calculates the cumulative conveyance distance of the printing paper P in the first conveyance direction M1 from the time the output of the paper detector 25 changes from No Paper (no-media state) to Paper Detected (media-detected state), and acquires the positions of the leading end and trailing end of the printing paper P in the conveyance direction based on the cumulative conveyance distance and the length of the printing paper P in the first conveyance direction M1. The cumulative conveyance distance can be calculated based on the length of time drive current is applied to the conveyance motor 17, for example. The length of the printing paper P can be acquired based on paper size information contained in the print data, or paper size information of the printing paper P set in the printer 1. The position acquisition unit 65 can be implemented with a component such as an optical sensor The control unit 61 also comprises a print control unit 66 that controls the printing process and conveyance operation, and a paper supply control unit 67 that controls the paper supply operation. In the printing process, the print control unit 66 alternately repeats the printing operation that drives while moving the printhead 26 on the transverse axis X and prints on the printing paper P, and the conveyance operation that conveys the printing paper P in conveyance distance increments appropriate to the print resolution specified by the print data. The paper supply control unit 67 drives the actuator 53 and the paper feed motor 15 to deliver a new sheet of printing paper P from the paper cassette 6 to the conveyance path 13 while the print control unit 66 drives the conveyance motor 17. The print control unit 66 can be implemented using software such as a firmware program.

In this embodiment, the paper supply control unit 67 drives the actuator 53, starts the retard preparation operation, and executes the paper supply operation at one of the drive times (1) to (4) described below. The paper supply control unit 67 can be implemented using software such as a firmware program.

(1) When the conveyance motor 17 is driving forward, the output of the paper detector 25 is Paper Detected, a paper discharge command (discharge command) to discharge the printing paper P from the paper exit 8 has been acquired, and the paper detector 25 output then changes to No Paper; or when the conveyance motor 17 is driving forward, the output of the paper detector 25 is No Paper, a paper discharge command has not been acquired, and the paper discharge command is then acquired.

(2) When it is determined based on the cumulative conveyance distance in the first conveyance direction M1 from the time the paper detector 25 output changes from No Paper to Paper Detected, and the length of the printing paper P in the first conveyance direction M1, that the printing paper P currently detected by the paper detector 25 and a newly conveyed sheet of printing paper P will not touch in the first conveyance direction M1.

(3) When it is determined based on the cumulative conveyance distance in the first conveyance direction M1 from the time the paper detector 25 output changes from No Paper to Paper Detected, and the length of the printing paper P in the first conveyance direction M1, that the distance between the printing paper P currently detected by the paper detector 25 and a newly conveyed sheet of printing paper P is greater than the distance between the second paper feed roller 21*a* and the second discharge roller 23*a*.

(4) When the conveyance motor 17 is driving forward and the output of the paper detector 25 changes from Paper Detected to No Paper.

Note that the paper discharge command is contained in the print data. The discharge command is considered acquired when the discharge command is interpreted by the print control unit 66.

The paper supply control unit 67 controls the paper supply mechanism 14 to execute the paper supply preparation operation in parallel with the retard preparation operation. More specifically, the paper supply control unit 67 drives the paper feed motor 15 at the above drive times to set the ridge 19*d* between the second outside surface 19*c* and the first outside surface 19*b* of the paper supply roller 19 against the printing paper P in the paper cassette 6, and then waits in this position. The paper supply control unit 67 then drives the paper feed motor 15 to turn the paper supply roller 19 to the initial position 19A, and feeds the printing paper P from the paper cassette 6 to the paper supply mechanism 14.

When a new sheet of printing paper P is delivered into the conveyance path 13 by the paper supply mechanism 14, the conveyance mechanism 16 operates by the conveyance motor 17 driving forward. The new printing paper P delivered into the conveyance path 13 is thereby conveyed by the conveyance mechanism 16.

The continuous conveyance operation of the printer 1 whereby a new sheet of printing paper P is fed from the paper cassette 6 to the conveyance path 13 before the printing paper P is conveyed through the conveyance path 13 is discharged from the paper exit 8 is described next. In this example, the paper supply control unit 67 can drive the actuator 53 at plural drive times. The continuous conveyance operation when the actuator 53 is driven at drive times (1) to (4) above are therefore described below as continuous conveyance operation examples 1 to 4.

Continuous conveyance operation example 1 is the continuous conveyance operation in which the drive timing for driving the actuator 53 is the time when the conveyance motor 17 is driving forward, the output of the paper detector 25 is Paper Detected, a paper discharge command (discharge command) to discharge the printing paper P from the paper exit 8 has been acquired, and the paper detector 25 output then changes to "no paper"; or when the conveyance motor 17 is driving forward, the output of the paper detector 25 is No Paper, a paper discharge command has not been acquired, and the paper discharge command is then acquired.

Figure 10A:
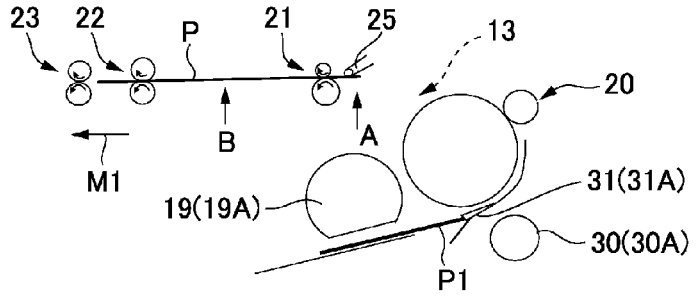
FIGS. 10A-10E illustrate a first example of the consecutive conveyance operation.
Figure 11:
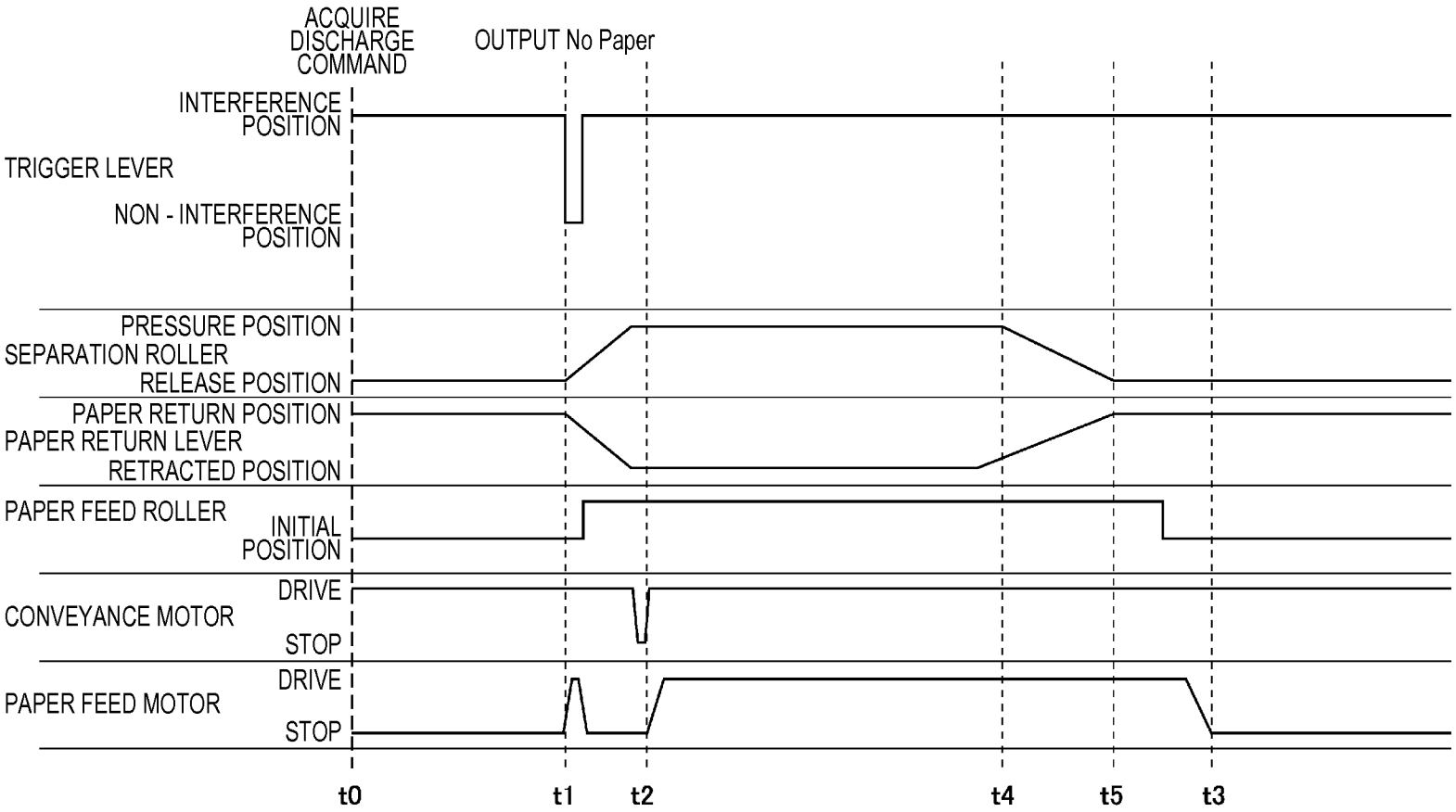
FIG. 11 is a timing chart of the first example of the consecutive conveyance operation.

FIG. 10A illustrates continuous conveyance operation example 1, and shows the relationship between the position of the printing paper P on the conveyance path 13, the output of the paper detector 25, and the positions of the separation roller 30 and paper return lever 31. FIG. 11 is a timing chart of continuous conveyance operation example 1.

In the state shown in FIG. 10A, the conveyance motor 17 is driving forward and a first sheet of printing paper P is being conveyed through the conveyance path 13. The printing paper P is being conveyed in the first conveyance direction M1 past print position B. In this example the control unit 61 has already acquired the discharge command (time t0 in FIG. 11), and the printing process has ended. Because the trailing end of the printing paper P in the first conveyance direction M1 has not past the detection position A, the paper detector 25 detects the printing paper P and Paper Detected is output from the paper detector 25. The paper supply roller 19 of the paper supply mechanism 14 is in the initial position 19A with the flat second outside surface 19*c* facing down opposite the printing paper P in the paper cassette 6. The separation roller 30 of the paper separating mechanism 27 is in the release position 30A, and the paper return lever 31 is in the paper return position 31A with the distal end 31*a* projecting into the conveyance path 13. In this state, the trigger lever 51 is in the interference position 51A interfering with the cam member 46. As a result, starting of the retard preparation operation is prevented.

Figure 10B:
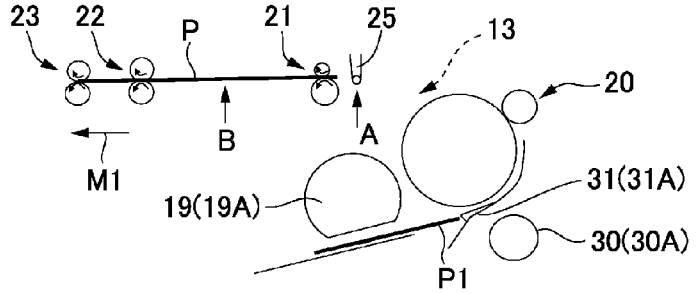

When the printing paper P is conveyed further in the first conveyance direction M1 by driving the conveyance motor 17 forward, the paper detector 25 stops detecting the printing paper P as shown in FIG. 10B, and No Paper is output from the paper detector 25. Because the control unit 61 has already acquired the discharge command in this example, the time when No Paper is output from the paper detector 25 is the drive timing for driving the actuator 53. This drive timing is time t1 in FIG. 11.

At time t1, the actuator 53 is driven. As a result, the trigger lever 51 moves from the interference position 51A to the non-interference position 51B. As a result, the cam member 46 turns, the operating member 47 rocks in one direction, and the retard preparation operation starts. Also at this drive timing, the paper feed motor 15 is driven and the paper supply preparation operation is executed to set the ridge 19*d* between the second outside surface 19*c* and first outside surface 19*b* of the paper supply roller 19 against the printing paper P in the paper cassette 6.

Figure 10C:
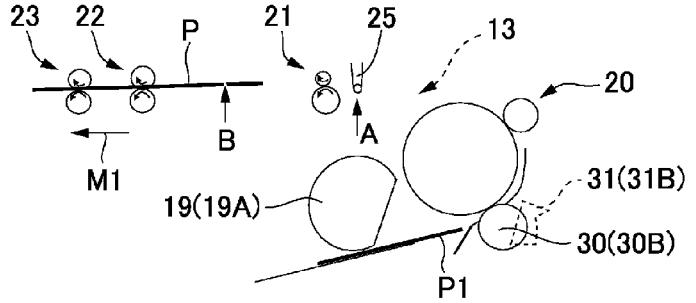
Figure 10D:
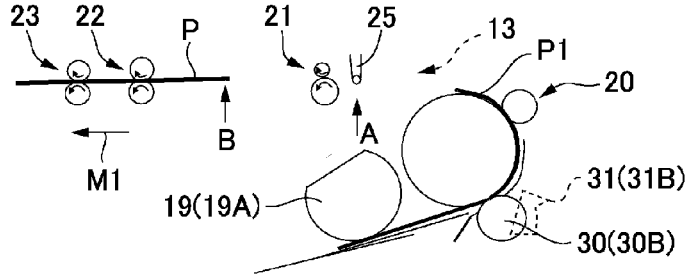

When the retard preparation operation ends, the separation roller 30 is at the pressure position 30B and the paper return lever 31 is at the retracted position 31B as shown in FIG. 10C (time t2 in FIG. 11). The paper feed motor 15 is then driven for a specific time (the time from t2 to t3). As a result, the paper supply roller 19 rotates to the initial position 19A, and a new sheet of printing paper P1 is fed from the paper cassette 6 to the conveyance path 13 as shown in FIG. 10D. The new sheet of printing paper P1 fed into the conveyance path 13 is conveyed by the conveyance mechanism 16 in the first conveyance direction M1 through the conveyance path 13. When the new sheet of printing paper P1 is fed into the conveyance path 13, the previous sheet of printing paper P being printed on is nipped and being conveyed by the first discharge roller pair 22 and second discharge roller pair 23.

Figure 10E:
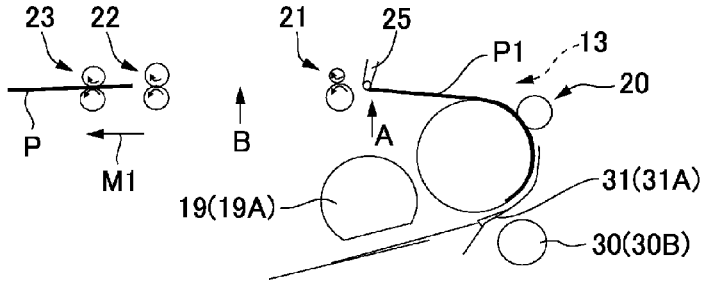

The new sheet of printing paper P1 is then conveyed by the conveyance mechanism 16 through the conveyance path 13 in the first conveyance direction M1. Next, as shown in FIG. 10E, the new sheet of printing paper P1 is detected by the paper detector 25, and Paper Detected is output from the paper detector 25. At this time the printing paper P conveyed first through the conveyance path 13 is nipped and conveyed by only the second discharge roller pair 23. Note that in this example the distance between the sheet of printing paper P conveyed first and the new sheet of printing paper P1 is approximate to the distance between the second paper feed roller 21*a* and the second discharge roller 23*a* located at the downstream end of the conveyance path 13. The new sheet of printing paper P1 is therefore nipped by the second paper feed roller pair 21 when the printing paper P being previously conveyed through the conveyance path 13 leaves the nipping point of the second discharge roller pair 23.

At this point the separation roller 30 is set to the pressure position 30B pressed against the first paper feed roller 20*a* by the retard preparation operation executed from time t1 to time t2 in FIG. 11. Therefore, when plural sheets of printing paper P are multifed by the paper supply mechanism 14 to the conveyance path 13, a single sheet of printing paper P is separated when passing the nipping position C of the first paper feed roller 20*a* and the separation roller 30 as shown in FIG. 10D and advances into the curved conveyance path portion 13*b*, and the excess sheets of printing paper P remain in the sloped conveyance path portion 13*a*. After this printing paper P separating operation ends, the operating member 47 rocks in the other direction by rotation of the cam member 46 at time t4 before time t3 at which the paper supply operation of the paper supply mechanism 14 ends. The separation roller 30 therefore returns from the pressure position 30B to the release position 30A, and the paper return lever 31 returns from the retracted position 31B to the paper return position 31A at time t5 before time t3 at which the paper supply operation ends. As shown in FIG. 10E, when the paper return lever 31 returns to the paper return position 31A, the paper return lever 31 moves the excess printing paper P left on the sloped conveyance path portion 13*a* to the paper cassette 6 side.

Note that in the example shown in FIG. 11, the conveyance motor 17 stops just before the paper feed motor 15 is driven (before time t2), but the conveyance motor 17 does not need to stop.

When the output of the paper detector 25 is No Paper and a discharge command has not been acquired, the next drive timing is when the discharge command is acquired. The same continuous conveyance operation described in FIG. 10B to FIG. 10E above is then executed when the drive timing comes. The continuous conveyance operation is also executed as described above from time t1 in FIG. 11.

The timing for driving the trigger lever 51 can be determined based on the output from the paper detector 25 and acquisition of the discharge command in continuous conveyance operation example 1. After confirming based on the discharge command that the process of printing on the printing paper P conveyed first has ended, the actuator 53 is driven and a new sheet of printing paper P1 is fed into the conveyance path 13. The printing paper P conveyed first through the conveyance path 13, and the next sheet of printing paper P1 fed into the conveyance path 13, can therefore be prevented from touching even when the conveyance speed of the printing paper P conveyed past the print position B drops due to the printing process.

Continuous conveyance operation example 2 is the continuous conveyance operation in which the drive timing for driving the actuator 53 is the time when it is determined based on the cumulative conveyance distance in the first conveyance direction M1 from the time the paper detector 25 output changes from No Paper to Paper Detected, and the length of the printing paper P in the first conveyance direction M1, that the printing paper P currently detected by the paper detector 25 and a newly conveyed sheet of printing paper P will not touch in the first conveyance direction M1.

FIGS. 12A-12E illustrate continuous conveyance operation example 2, and shows the relationship between the position of the printing paper P on the conveyance path 13, the output of the paper detector 25, and the positions of the separation roller 30 and paper return lever 31.

Figure 12A:
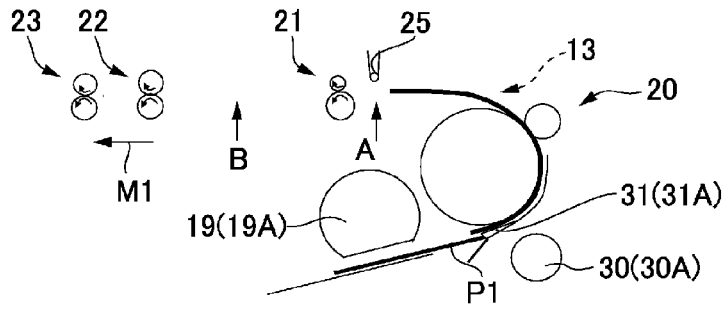
FIGS. 12A-12E illustrate a second example of the consecutive conveyance operation.
Figure 12B:
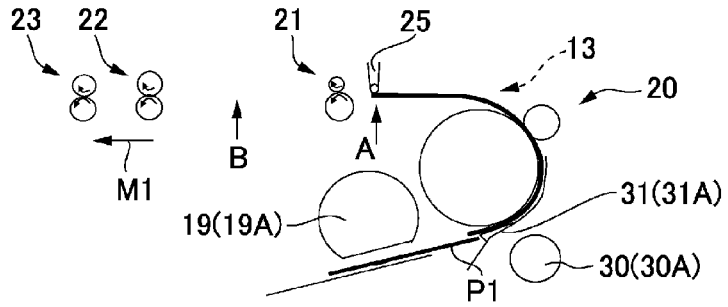

In the state shown in FIG. 12A, the conveyance motor 17 is driving forward, and a first sheet of printing paper P is being conveyed through the conveyance path 13. The leading end of the printing paper P in the first conveyance direction M1 has not reached the detection position A. Therefore, the paper detector 25 has not detected the printing paper P, and No Paper is output from the paper detector 25. The paper supply roller 19 of the paper supply mechanism 14 is in the initial position 19A with the flat second outside surface 19*c* facing down opposite the printing paper P in the paper cassette 6. The separation roller 30 of the paper separating mechanism 27 is in the release position 30A, and the paper return lever 31 is in the paper return position 31A with the distal end 31*a* projecting into the conveyance path 13. In this state, the trigger lever 51 is in the interference position 51A interfering with the cam member 46. As a result, starting the retard preparation operation is prevented.

When the printing paper P is conveyed further in the first conveyance direction M1 by driving the conveyance motor 17 forward, the leading end of the printing paper P in the first conveyance direction M1 passes the detection position A. Because the output of the paper detector 25 therefore changes from No Paper to Paper Detected, the position acquisition unit 65 of the control unit 61 calculates the cumulative conveyance distance of the printing paper P in the first conveyance direction M1 from the time the output of the paper detector 25 changes from No Paper to Paper Detected, and acquires the position of the trailing end of the printing paper P in the first conveyance direction M1 based on the cumulative conveyance distance and the length of the printing paper P in the first conveyance direction M1.

The printing paper P is then conveyed further in the first conveyance direction M1 by driving the conveyance motor 17 forward, and the position acquisition unit 65 knows that the trailing end of the printing paper P in the first conveyance direction M1 detected by the paper detector 25 is located on the downstream side in the first conveyance direction M1 from the nipping position C of the first paper feed roller 20*a* and separation roller 30. The paper supply control unit 67 therefore knows that at this time the printing paper P detected by the paper detector 25 and the new sheet of conveyed printing paper P1 will not touch in the first conveyance direction M1, and uses this time as the drive timing to drive the actuator 53.

When the actuator 53 is driven, the trigger lever 51 moves from the interference position 51A to the non-interference position 51B. As a result, the trigger lever 51 moves from the interference position 51A to the non-interference position 51B. The cam member 46 therefore turns, the operating member 47 rocks in one direction, and the retard preparation operation starts. Also at this drive timing, the paper feed motor 15 is driven and the paper supply preparation operation is executed to set the ridge 19*d* between the second outside surface 19*c* and first outside surface 19*b* of the paper supply roller 19 against the printing paper P in the paper cassette 6.

Figure 12C:
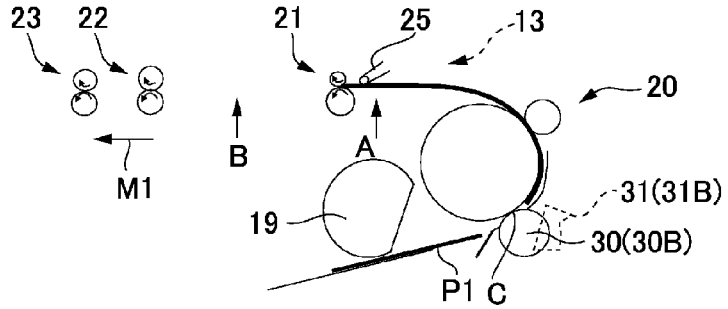

When the retard preparation operation ends, the separation roller 30 is at the pressure position 30B and the paper return lever 31 is at the retracted position 31B as shown in FIG. 12C.

Figure 12D:
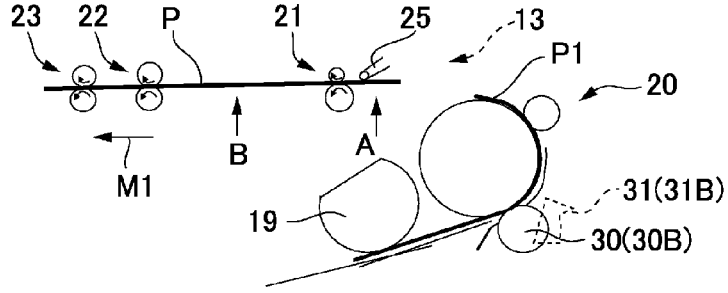

The paper feed motor 15 is then driven for a specific time. As a result, the paper supply roller 19 turns, and a new sheet of printing paper P1 is fed from the paper cassette 6 to the conveyance path 13 as shown in FIG. 12D. The new sheet of printing paper P1 fed into the conveyance path 13 is conveyed by the conveyance mechanism 16 in the first conveyance direction M1 through the conveyance path 13.

Figure 12E:
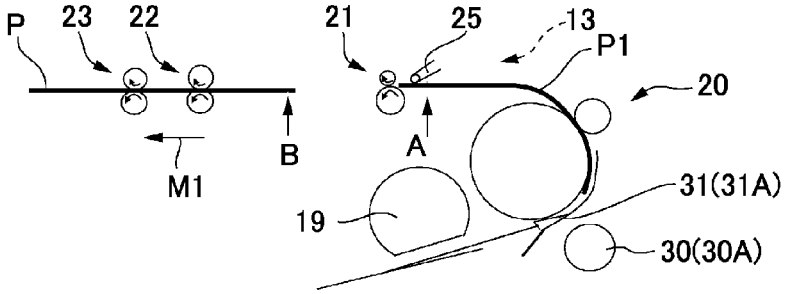

When the new sheet of printing paper P1 is fed into the conveyance path 13, the previous sheet of printing paper P conveyed through the conveyance path 13 is being printed, and is nipped and conveyed by the second paper feed roller pair 21, first discharge roller pair 22, and second discharge roller pair 23. The paper detector 25 also detects the printing paper P conveyed first through the conveyance path 13, and Paper Detected is output from the paper detector 25. When the new sheet of printing paper P1 is then detected by the paper detector 25, the separation roller 30 returns to the release position 30A and the paper return lever 31 returns to the paper return position 31A as shown in FIG. 12E. The paper supply roller 19 is also returned to the initial position 19A.

The separation roller 30 is also set to the pressure position 30B pressed against the first paper feed roller 20*a* by the retard preparation operation in this example. Therefore, when plural sheets of printing paper P are multifed by the paper supply mechanism 14 to the conveyance path 13, a single sheet of printing paper P is separated when passing the nipping position C of the first paper feed roller 20*a* and the separation roller 30 as shown in FIG. 12D and advances into the curved conveyance path portion 13*b*, and the excess sheets of printing paper P remain in the sloped conveyance path portion 13*a*. After this printing paper P separating operation ends, the separation roller 30 returns from the pressure position 30B to the release position 30A, and the paper return lever 31 returns from the retracted position 31B to the paper return position 31A as shown in FIG. 12E. When the paper return lever 31 returns to the paper return position 31A, the paper return lever 31 also moves the excess printing paper P left on the sloped conveyance path portion 13*a* to the paper cassette 6 side.

In continuous conveyance operation example 2, the drive timing for driving the actuator 53 can thus be set based on the length of the printing paper P in the first conveyance direction M1 and the cumulative conveyance distance of the first-conveyed printing paper P from the detection position A. The distance between two consecutively conveyed sheets of printing paper P can therefore be controlled to a short distance in which the consecutive sheets of printing paper P will not touch each other, and the throughput of a continuous printing process in which plural sheets of printing paper P are printed continuously one after another can be increased.

Continuous conveyance operation example 3 is the continuous conveyance operation in which the drive timing for driving the actuator 53 is the time when it is determined based on the cumulative conveyance distance in the first conveyance direction M1 from the time the paper detector 25 output changes from No Paper to Paper Detected, and the length of the printing paper P in the first conveyance direction M1, that the distance between the printing paper P currently detected by the paper detector 25 and a newly conveyed sheet of printing paper P is greater than the distance between the second paper feed roller 21*a* and the second discharge roller 23*a*.

FIGS. 13A-13E and FIGS. 14A-14C illustrate continuous conveyance operation example 3, and show the relationship between the position of the printing paper P on the conveyance path 13, the output of the paper detector 25, and the positions of the separation roller 30 and paper return lever 31.

Continuous conveyance operation example 3 is used when a de-skewing operation is applied to a newly conveyed sheet of printing paper P1.

The de-skewing operation is an operation that, when the output of the paper detector 25 changes from No Paper to Paper Detected, conveys the new sheet of printing paper P1 a first conveyance distance, which is greater than the distance between the detection position A and the second paper feed roller 21*a*, so that the new sheet of printing paper P1 is nipped by the second paper feed roller pair 21. Next, the conveyance motor 17 is driven in a second direction to convey the paper a second conveyance distance in the reverse conveyance direction to release the new sheet from the nipping position and set the new sheet against the second paper feed roller 21*a*. The second conveyance distance is shorter than the first conveyance distance, and the reverse conveyance direction is opposite the first conveyance direction.

The de-skewing operation conveys a new sheet of printing paper P1 a first conveyance distance, which is greater than the distance between the detection position A and the second paper feed roller 21*a* when the output of the paper detector 25 changes from No Paper to Paper Detected, and nips the new sheet of printing paper P1 with the second paper feed roller pair 21; and then drives the conveyance motor 17 in a second direction to convey the paper a second conveyance distance, which is shorter than the first conveyance distance, in the reverse conveyance direction, which is opposite the first conveyance direction, to release the new sheet from the nipping position and set it against the second paper feed roller 21*a*.

When the conveyance motor 17 drives in the second direction in this printer 1, drive power from the conveyance motor 17 is not transferred to the first paper feed roller 20*a* by the clutch mechanism 55 of the drive power transfer mechanism 18, and the first paper feed roller 20*a* is not driven. Therefore, if the printing paper P is skewed when the conveyance motor 17 drives in the second direction and is released from the nipping position in the de-skewing operation, the printing paper P sags between the second paper feed roller 21*a* and first paper feed roller 20*a*, and skewing of the paper is corrected by the printing paper P contacting the second paper feed roller 21*a*. Therefore, when the conveyance operation that conveys the printing paper P in the first conveyance direction M1 resumes after the de-skewing operation, skewing of the printing paper P is removed when the printing paper P is again nipped by the second paper feed roller pair 21.

Figure 13A:
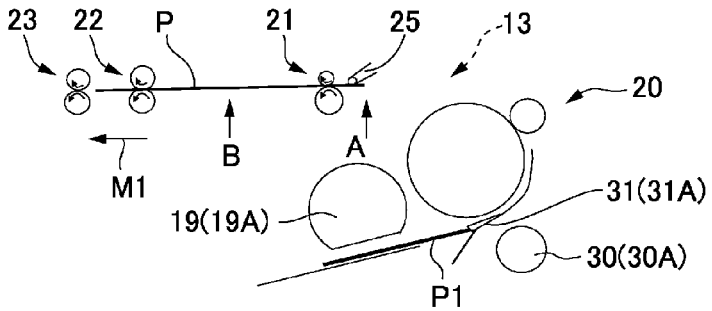
FIGS. 13A-13E illustrate a third example of the consecutive conveyance operation.

In the state shown in FIG. 13A, the conveyance motor 17 is driving forward and one sheet of printing paper P is already being conveyed through the conveyance path 13. The printing paper P is conveyed in the first conveyance direction M1 past the print position B. Because the trailing end of the printing paper P in the first conveyance direction M1 has not passed the detection position A, the paper detector 25 continues detecting the printing paper P and Paper Detected is output from the paper detector 25. The paper supply roller 19 of the paper supply mechanism 14 is in the initial position 19A with the flat second outside surface 19*c* facing down opposite the printing paper P in the paper cassette 6. The separation roller 30 of the paper separating mechanism 27 is in the release position 30A, and the paper return lever 31 is in the paper return position 31A with the distal end 31*a* projecting into the conveyance path 13. In this state, the trigger lever 51 is in the interference position 51A interfering with the cam member 46. As a result, starting the retard preparation operation is prevented.

As in continuous conveyance operation example 2, the position acquisition unit 65 of the control unit 61 calculates the cumulative conveyance distance of the printing paper P in the first conveyance direction M1 from the time the output of the paper detector 25 changes from No Paper to Paper Detected, and acquires the position of the trailing end of the printing paper P in the first conveyance direction M1 based on the cumulative conveyance distance and the length of the printing paper P in the first conveyance direction M1.

Figure 13B:
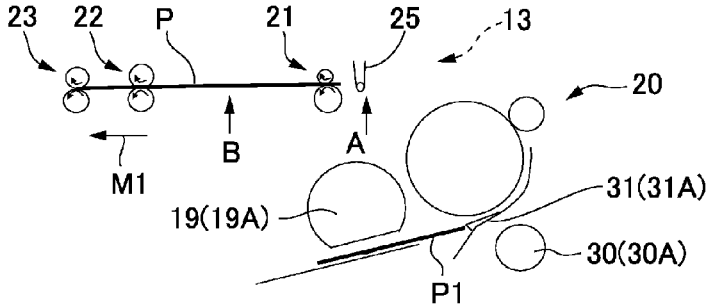

When the printing paper P is then conveyed further in the first conveyance direction M1 to the state shown in FIG. 13B by driving the conveyance motor 17 forward, the control unit 61 drives the actuator 53 using as the drive timing the time when, based on the position of the printing paper P on the conveyance path 13 acquired by the position acquisition unit 65, the distance between the printing paper P detected by the paper detector 25 and the next conveyed sheet of printing paper P1 is determined to be greater than the distance between the second paper feed roller 21*a* and the second discharge roller 23*a*.

When the actuator 53 is driven, the trigger lever 51 moves from the interference position 51A to the non-interference position 51B. As a result, the trigger lever 51 moves from the interference position 51A to the non-interference position 51B. The cam member 46 therefore turns, the operating member 47 rocks in one direction, and the retard preparation operation starts. Also at this drive timing, the paper feed motor 15 is driven and the paper supply preparation operation is executed to set the ridge 19*d* between the second outside surface 19*c* and first outside surface 19*b* of the paper supply roller 19 against the printing paper P in the paper cassette 6.

Figure 13C:
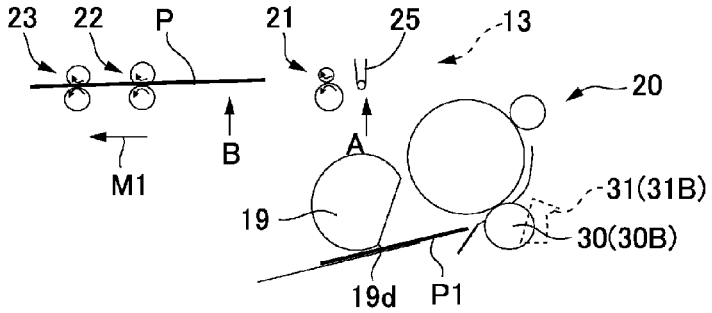
Figure 13D:
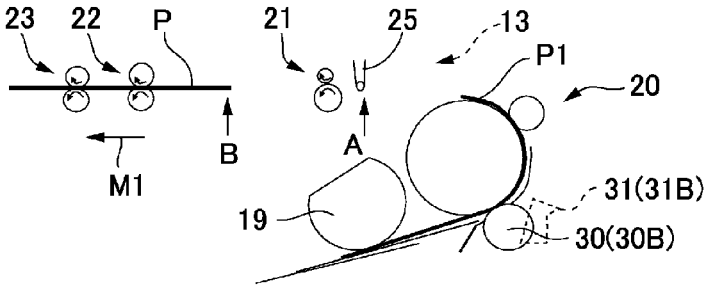

When the retard preparation operation ends, the separation roller 30 is at the pressure position 30B and the paper return lever 31 is at the retracted position 31B as shown in FIG. 13C. The paper feed motor 15 is then driven for a specific time. As a result, the paper supply roller 19 turns to the initial position 19A, and a new sheet of printing paper P1 is fed from the paper cassette 6 to the conveyance path 13 as shown in FIG. 13D. The new sheet of printing paper P1 fed into the conveyance path 13 is conveyed by the conveyance mechanism 16 in the first conveyance direction M1 through the conveyance path 13.

Figure 13E:
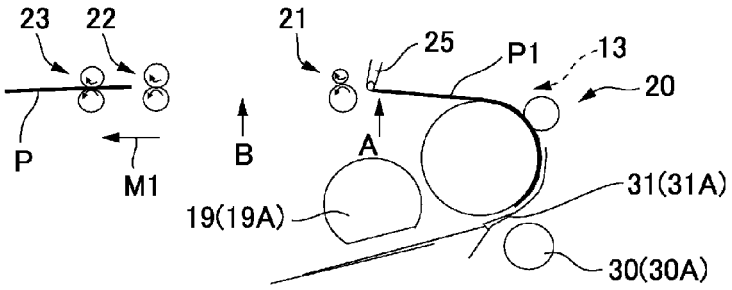

The new sheet of printing paper P1 is then conveyed by the conveyance mechanism 16 in the first conveyance direction M1 through the conveyance path 13, and is detected by the paper detector 25 as shown in FIG. 13E. Paper Detected is therefore output from the paper detector 25.

Figure 14A:
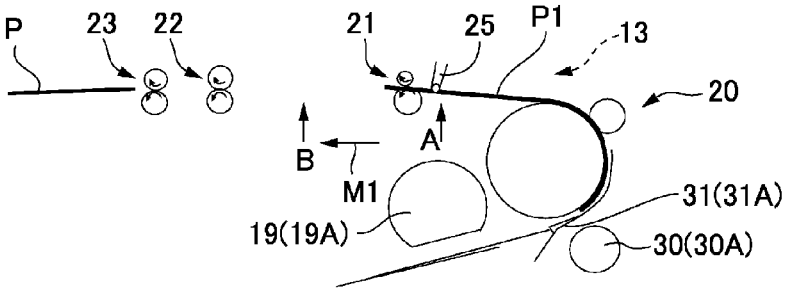
FIGS. 14A-14C illustrate the de-skewing operation in the third consecutive conveyance operation.
Figure 14B:
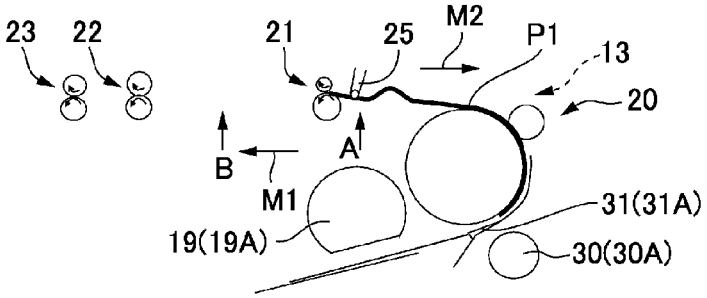

When the output of the paper detector 25 changes from No Paper to Paper Detected, the de-skewing operation is applied to the new sheet of printing paper P1. More specifically, as shown in FIG. 14A, the new sheet of printing paper P1 is conveyed a first conveyance distance in the first conveyance direction M1, and nipped by the second paper feed roller pair 21. Next, as shown in FIG. 14B, the conveyance motor 17 is driven in a second direction to convey the printing paper P a second conveyance distance in the second conveyance direction M2 so that the paper is not nipped, and the printing paper P is set against the second paper feed roller pair 21.

The distance between the new sheet of printing paper P1 and the printing paper P conveyed first through the conveyance path 13 in this example is greater than the distance between the second paper feed roller 21*a* and the second discharge roller 23*a*. Therefore, as shown in FIG. 14A, at the time the new sheet of printing paper P1 is nipped by the second paper feed roller pair 21 in the de-skewing operation, the printing paper P conveyed first through the conveyance path 13 is located on the downstream side in the first conveyance direction M1 from the nipping position of the second discharge roller pair 23. That is, the printing paper P conveyed first is discharged from the paper exit 8 before the conveyance motor 17 is driven in reverse and the new sheet of printing paper P1 is conveyed in the second conveyance direction. Therefore, the printing paper P conveyed first will not be conveyed in the second conveyance direction M2 due to the de-skewing operation applied to the new sheet of printing paper P1.

Figure 14C:
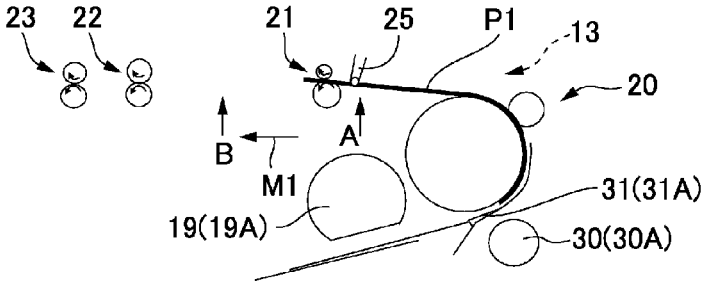

When the de-skewing operation ends, as shown in FIG. 14C, the conveyance motor 17 is driven forward again, and the new sheet of printing paper P1 is conveyed forward. The printing paper P is then printed on by the printhead 26 while being conveyed in the first conveyance direction M1 past the print position B.

Continuous conveyance operation example 4 is the continuous conveyance operation in which the drive timing for driving the actuator 53 is the time when the conveyance motor 17 is driving forward and the output of the paper detector 25 changes from Paper Detected to No Paper. In this example, the actuator 53 is driven and the retard preparation operation and paper supply preparation operation start when the state in FIG. 10B is reached regardless of whether or not the discharge command has been received. Operation after the retard preparation operation and the paper supply preparation operation end is the same as described in continuous conveyance operation example 1 above, and further description thereof is omitted.

In continuous conveyance operation example 4, the timing for driving the trigger lever 51 can be determined based on output from the paper detector 25. Furthermore, because conveying the next new sheet of printing paper P1 starts after the time the printing paper P conveyed first through the conveyance path 13 passes the detection position A, at least a specific distance can be maintained between the printing paper P conveyed first and the new sheet of printing paper P1. The printing paper P conveyed first and the next new sheet of printing paper P1 can therefore be prevented by a simple control method from colliding on the conveyance path 13 when, for example, the conveyance speed of the printing paper P does not drop significantly during the printing operation due to the printing process applied to the printing paper P conveyed first.

In continuous conveyance operation examples 2 and 3, which determine the drive timing for driving the actuator 53 based on the length of the printing paper P in the first conveyance direction M1 and the cumulative conveyance distance in the first conveyance direction M1 from the time the output of the paper detector 25 changes from No Paper to Paper Detected, if the actuator 53 is driven and the paper supply operation executed at the drive timing set based on the standard in continuous conveyance operation examples 2 and 3, the printing paper P conveyed first and the new sheet of printing paper P1 conveyed next through the conveyance path 13 may collide depending on the print resolution of the printing process. Maintaining the desired distance between these two sheets of printing paper P may also not be possible.

More specifically, depending on the print resolution, the conveyance distance of the conveyance operation performed intermittently during the printing process may be extremely short, and this conveyance distance may be less than the minimum conveyance amount that the supply mechanism conveys the medium when the supply motor is driven the smallest angle corresponding to the print resolution. In this event, if the retard preparation operation executes and the paper supply operation starts at a predetermined drive timing, the new sheet of printing paper P1 fed into the conveyance path 13 may collide with the printing paper P conveyed first if the paper feed distance of the new media fed into the conveyance path 13 by the paper supply operation is great. Maintaining a desired distance between these two sheets of printing paper P may also not be possible. Therefore, in these events, the new sheet of media can be prevented from colliding with the media fed first through the conveyance path 13 by executing the retard preparation operation and starting the paper supply operation at a timing delayed from the drive timing set based on the standard of continuous conveyance operation examples 2 and 3.

More specifically, the print control unit 66 acquires the conveyance amount of each conveyance operation performed intermittently during the printing process, and the paper supply control unit 67 compares this conveyance amount with the minimum conveyance amount of the supply mechanism corresponding to the resolution of the supply motor.

When the conveyance amount is greater than the minimum conveyance amount of the supply mechanism corresponding to the resolution of the supply motor, the actuator 53 is driven at the drive timing set based on the standard of continuous conveyance operation examples 2 and 3, the retard preparation operation starts, and the paper supply operation executes.

When the conveyance amount is less than the minimum conveyance amount of the supply mechanism corresponding to the resolution of the supply motor, the actuator 53 is driven at a timing later than the drive timing set based on the standard of continuous conveyance operation examples 2 and 3, the retard preparation operation starts, and the paper supply operation executes.

In this event, the timing later than the drive timing set based on the standard of continuous conveyance operation examples 2 and 3 could be either the time when the conveyance motor 17 is driving forward, the output of the paper detector 25 is Paper Detected, a paper discharge command (discharge command) to discharge the printing paper P from the paper exit 8 has been acquired, and the paper detector 25 output then changes to "no paper"; or when the conveyance motor 17 is driving forward, the output of the paper detector 25 is No Paper, a paper discharge command has not been acquired, and the paper discharge command is then acquired, as described in continuous conveyance operation example 1.

This can prevent the media conveyed first through the conveyance path 13, and the new media delivered to the conveyance path 13, from contacting on the conveyance path 13. If the actuator 53 is driven and the paper supply operation executed at this drive timing in the printer 1 according to this embodiment, the distance between the printing paper P conveyed first and the new sheet of printing paper P1 corresponds to the distance between the second paper feed roller 21*a* and the second discharge roller 23*a* at the downstream end of the conveyance path 13. Therefore, if the actuator 53 is driven and the paper supply operation is executed at this drive timing when the de-skewing operation is executed, the printing paper P conveyed first through the conveyance path 13 will not be conveyed in the second conveyance direction by the de-skewing operation applied to the new sheet of printing paper P1.

The paper supply control unit 67 could alternatively calculate a second cumulative conveyance distance of the media from the drive timing set based on the standard of continuous conveyance operation examples 2 and 3, and set the time when the second cumulative conveyance distance is the minimum conveyance amount of the supply mechanism corresponding to the resolution of the supply motor as a timing that is later than the drive timing set based on the standard of continuous conveyance operation examples 2 and 3, for example. In this configuration, contact on the conveyance path 13 between the medium conveyed first through the conveyance path 13 and the new medium delivered to the conveyance path 13 can be prevented even when conveyance amount of the new medium delivered to the conveyance path 13 by the paper supply operation is great.

Other Embodiments

The embodiment of the invention described above applies the invention to a printer 1, but the invention can be similarly applied to scanners, fax machines, and other types of media processing devices.

The invention being thus described, it will be apparent that it may be varied in many ways. Such variations are not to be regarded as a departure from the spirit and scope of the invention, and all such modifications as would be apparent to one skilled in the art are intended to be included within the scope of the following claims.

What is claimed is:

1. A media processing device comprising:

a conveyance path going from a supply unit that stores plural sheets of media to a discharge exit;

a first conveyance roller that conveys the media through the conveyance path;

a separation roller that can move between a pressure position pressed to the first conveyance roller, and a release position separated from the first conveyance roller;

a paper return lever that can move between a paper return position where a part of the paper return lever protrudes into the conveyance path upstream from the first conveyance roller, and a retracted position where the paper return lever is retracted from the conveyance path;

a moving mechanism that performs a retard preparation operation that moves the paper return lever from the paper return position to the retracted position, and moves the separation roller from the release position to the pressure position;

a trigger lever that can move between an interference position physically interfering with the moving mechanism and preventing starting of the retard preparation operation, and a non-interference position that does not interfere with the moving mechanism and allowing the retard preparation operation to start;

a conveyance motor;

the first conveyance roller, a second conveyance roller, and a discharge roller disposed in order from the upstream side of the conveyance direction from the supply unit to the discharge exit to convey media through the conveyance path;

a drive power transfer mechanism that transfers drive power from the conveyance motor to the first conveyance roller, the second conveyance roller, the discharge roller, and moving mechanism;

a supply mechanism that performs a supply operation that delivers a new medium to the conveyance path from the supply unit when the retard preparation operation ends before the medium is discharged from the discharge exit;

a control unit that controls driving of the conveyance motor and an actuator that moves the trigger lever from the interference position to the non-interference position; and a detector that detects and outputs to the control unit whether or not the medium is at a detection position set on the conveyance path between the first conveyance roller and the second conveyance roller; wherein when a discharge command to discharge the media from the discharge exit is acquired while the conveyance motor is driving and the detector output is in a media-detected state, the control unit drives the actuator when the detector output changes to a no-media state, and when the discharge command has not been acquired while the conveyance motor is driving and the detector output is in a no-media state, the control unit drives the actuator when the discharge command is acquired.

2. The media processing device described in claim 1, wherein the control unit calculates a cumulative conveyance distance in the conveyance direction of the medium from the time the detector output changes from the no-media state to the media-detected state, and drives the actuator based on the cumulative conveyance distance and the length of the medium in the conveyance direction.

3. The media processing device described in claim 1, wherein the control unit drives the actuator when the detector output changes from the media-detected state to the no-media state while the conveyance motor is driving.

4. The media processing device described in claim 3, further comprising a clutch mechanism that transfers drive power from the conveyance motor to the first conveyance roller when the conveyance motor is driven in a first direction, and interrupts transfer of drive power to the first conveyance roller when the conveyance motor is driven in a second direction that is the reverse of the first direction.

5. A control method of the media processing device described in claim 1, the control method comprising:

executing a conveyance operation of driving the conveyance motor, rotating the first conveyance roller, the second conveyance roller, and the discharge roller, and conveying the medium delivered from the supply unit to the conveyance path in the conveyance direction;

setting the trigger lever to the interference position;

if the detector output is in a media-detected state and a discharge command to discharge the media from the discharge exit has been acquired, driving the actuator and starting the retard preparation operation when the detector output changes to a no-media state; and if the discharge command is not acquired after the detector output changes from the media-detected state to the no-media state, driving an actuator that moves the trigger lever from the interference position to the non-interference position, and starting the retard preparation operation, when the discharge command is acquired.

6. A control method of the media processing device described in claim 1, the control method comprising:

executing a conveyance operation of driving the conveyance motor, rotating the first conveyance roller, the second conveyance roller, and the discharge roller, and conveying the medium delivered from the supply unit to the conveyance path in the conveyance direction;

setting the trigger lever to the interference position;

calculating a cumulative conveyance distance of the medium conveyed in the conveyance direction from the time the detector output changes from the no-media state to the media-detected state, and setting a drive timing to drive the actuator based on the cumulative conveyance distance and the length of the medium in the conveyance direction; and driving the actuator and starting the retard preparation operation at the drive timing.

7. The control method of the media processing device described in claim 6, further comprising:

setting the time when the trailing end in the conveyance direction of the medium detected by the detector is determined to pass a nipping part of the first conveyance roller and the separation roller as the drive timing based on the cumulative conveyance distance and the length of the medium in the conveyance direction; and driving the actuator at the drive timing.

8. The control method of the media processing device described in claim 6, wherein the media processing device has a clutch mechanism that transfers drive power from the conveyance motor to the first conveyance roller when the conveyance motor is driven in a first direction, and interrupts transfer of drive power to the first conveyance roller when the conveyance motor is driven in a second direction that is the reverse of the first direction, the control method further comprising:

driving the conveyance motor in the first direction in the conveyance operation;

setting the time when the distance between the medium detected by the detector and a new medium supplied next from the supply unit to the conveyance path is determined to be greater than the distance between the second conveyance roller and the discharge roller as the drive timing based on the cumulative conveyance distance and the length of the medium in the conveyance direction;

driving the actuator and starting the retard preparation operation at the drive timing;

executing the supply operation and the conveyance operation of a new medium after the retard preparation operation ends;

executing a de-skewing operation of conveying the new medium a first conveyance distance that is greater than the distance between the detection position and the second conveyance roller when the detector output changes from the no-media state to the media-detected state, driving the conveyance motor in the second direction and conveying the medium in a reverse conveyance direction that is the opposite of the conveyance direction a second conveyance distance that is less than the first conveyance distance so that the new medium is not nipped, and setting the new medium against the second conveyance roller; and then resuming the conveyance operation.

9. A control method of the media processing device described in claim 1, the control method comprising:

executing a conveyance operation of driving the conveyance motor, rotating the first conveyance roller, the second conveyance roller, and the discharge roller, and conveying the medium delivered from the supply unit to the conveyance path in the conveyance direction;

setting the trigger lever to the interference position; and driving the actuator and starting the retard preparation operation when the detector output changes from the media-detected state to the no-media state.

10. A control method of the media processing device described in claim 1, the media processing device having a printhead that executes a printing process, the control method comprising:

executing a conveyance operation of driving the conveyance motor, rotating the first conveyance roller, the second conveyance roller, and the discharge roller, and conveying the medium delivered from the supply unit to the conveyance path in the conveyance direction;

setting the trigger lever to the interference position;

calculating a cumulative conveyance distance of the medium conveyed in the conveyance direction from the time the detector output changes from the no-media state to the media-detected state, and setting a drive timing to drive the actuator based on the cumulative conveyance distance and the length of the medium in the conveyance direction;

alternating the printing operation on the medium at the processing position and the conveyance operation in the printing process;

acquiring the conveyance distance of each conveyance operation performed alternately in the printing process;

driving the actuator at the drive timing and starting the retard preparation operation if the conveyance distance is greater than the minimum conveyance amount of the supply mechanism corresponding to the resolution of the conveyance motor; and driving the actuator at a timing later than the drive timing and starting the retard preparation operation if the conveyance distance is less than the minimum conveyance amount of the supply mechanism.

11. The control method of the media processing device described in claim 10, further comprising:

driving the actuator and starting the retard preparation operation if the output changes to the no-media state when the conveyance distance is less than the minimum conveyance amount of the supply mechanism, the output of the detector is the media-detected state, and a discharge command to discharge the medium from the discharge exit has been acquired, and driving the actuator and starting the retard preparation operation if the discharge command is acquired when the discharge command has not been acquired after the detector output changes from the media-detected state to the no-media state.

12. The control method of the media processing device described in claim 10, further comprising:

calculating a second cumulative conveyance distance of the medium from when the drive timing is reached if the conveyance distance is less than the minimum conveyance amount of the supply mechanism, and driving the actuator and starting the retard preparation operation if the second cumulative conveyance distance is less than the minimum conveyance amount.

* * * * *